US012135187B1

(12) United States Patent
Crye

(10) Patent No.: US 12,135,187 B1
(45) Date of Patent: Nov. 5, 2024

(54) APPARATUS, SYSTEMS, AND METHODS OF AUTHORIZING AN OPERATION FOR A PORTABLE LAUNCH ASSEMBLY

(71) Applicant: Caleb Crye, Brooklyn, NY (US)

(72) Inventor: Caleb Crye, Brooklyn, NY (US)

( * ) Notice: Subject to any disclaimer, the term of this patent is extended or adjusted under 35 U.S.C. 154(b) by 30 days.

(21) Appl. No.: 18/527,870

(22) Filed: Dec. 4, 2023

Related U.S. Application Data

(63) Continuation-in-part of application No. 17/703,149, filed on Mar. 24, 2022.

(60) Provisional application No. 63/220,656, filed on Jul. 12, 2021.

(51) Int. Cl.
*F41F 3/04* (2006.01)

(52) U.S. Cl.
CPC ..... *F41F 3/04* (2013.01)

(58) Field of Classification Search
CPC ..... F41F 3/04
See application file for complete search history.

(56) References Cited

U.S. PATENT DOCUMENTS

| | | | | |
|---|---|---|---|---|
| 6,244,535 | B1 | 6/2001 | Felix | |
| 7,249,730 | B1 * | 7/2007 | Flippen, Jr. | F41G 7/346 342/61 |
| 8,266,999 | B1 | 9/2012 | Sisemore et al. | |
| 8,397,613 | B2 | 3/2013 | Skurdal et al. | |
| 8,525,088 | B1 | 9/2013 | Ell et al. | |
| 9,157,717 | B1 | 10/2015 | Carroll et al. | |
| 9,354,029 | B2 | 5/2016 | Mace et al. | |
| 9,772,155 | B2 | 9/2017 | Schechter | |
| 10,029,791 | B2 | 7/2018 | Roemerman et al. | |
| 10,648,781 | B1 | 5/2020 | Behiel | |
| 10,757,000 | B2 | 8/2020 | Gelvin et al. | |
| 11,105,589 | B1 | 8/2021 | Bilbrey et al. | |
| 11,198,519 | B1 * | 12/2021 | Seeley | B64C 11/06 |
| 11,355,021 | B1 * | 6/2022 | Miao | G08G 5/0039 |
| 2010/0000463 | A1 | 1/2010 | Root, Jr. | |

(Continued)

FOREIGN PATENT DOCUMENTS

| | | | | |
|---|---|---|---|---|
| CN | 109447398 | A | 3/2019 | |
| CN | 112783195 | A * | 5/2021 | G05D 1/101 |

(Continued)

OTHER PUBLICATIONS

Machine Translation of CN112783195A (Year: 2021).*

(Continued)

*Primary Examiner* — Sahar Motazedi
(74) *Attorney, Agent, or Firm* — Patterson Intellectual Property Law, PC

(57) ABSTRACT

A method for authorizing and executing an operation for at least one portable launch assembly in a potential area is disclosed. An initial launch parameter set corresponding to an intended area is provided to a launch unit. An airspace deconfliction (AD) module within one or more electronic devices is provided an authorization to launch the launch unit based on an airspace collision avoidance status that is determined by ensuring there are no possible points of intersection between the launch unit and an air vehicle in an airspace surrounding the launch unit. After launch, the launch unit confirms an intended launch status according to one or more measured launch parameters, and, based upon the confirmed launch status, guides the launch unit to the intended area.

11 Claims, 13 Drawing Sheets

(56) References Cited

U.S. PATENT DOCUMENTS

| | | | | |
|---|---|---|---|---|
| 2010/0320312 | A1* | 12/2010 | Bril | F41G 7/2213 89/1.8 |
| 2011/0059421 | A1 | 3/2011 | Hickman | |
| 2012/0024136 | A1* | 2/2012 | McCants, Jr. | B64D 1/04 89/1.819 |
| 2016/0223278 | A1* | 8/2016 | Schechter | F41A 17/063 |
| 2017/0286654 | A1 | 10/2017 | Nicoll | |
| 2017/0372617 | A1* | 12/2017 | Bruno | G08G 5/003 |
| 2019/0220039 | A1 | 7/2019 | Wu et al. | |
| 2020/0088887 | A1* | 3/2020 | Garcia | G01S 5/06 |
| 2021/0070440 | A1* | 3/2021 | Abeles | B64C 39/024 |
| 2021/0094703 | A1* | 4/2021 | Catledge | B64G 1/242 |

FOREIGN PATENT DOCUMENTS

| | | | | | |
|---|---|---|---|---|---|
| EP | 3081892 | A1 | * | 10/2016 | |
| EP | 4239277 | A1 | * | 9/2023 | F41G 7/006 |
| KR | 20150104323 | A | * | 9/2015 | |
| KR | 102021595 | B1 | * | 9/2019 | |
| RU | 2213315 | C2 | | 9/2003 | |
| WO | 2016024921 | A1 | | 2/2016 | |
| WO | 2021014101 | A1 | | 1/2021 | |
| WO | 2021156634 | A1 | | 8/2021 | |

OTHER PUBLICATIONS

Machine Translation of KR102021595B1 (Year: 2019).*
Machine Translation of KR20150104323A (Year: 2015).*
Machine Translation of EP-3081892-A1 (Year: 2016).*
Machine Translation of EP-4239277-A1 (Year: 2023).*

* cited by examiner

APPARATUS, SYSTEMS, AND METHODS OF AUTHORIZING AN OPERATION FOR A PORTABLE LAUNCH ASSEMBLY

CROSS-REFERENCES TO RELATED APPLICATIONS

This application claims benefit of U.S. Nonprovisional patent application Ser. No. 17/703,149 filed Mar. 24, 2022 that claims the benefit of U.S. Provisional Patent Application No. 63/220,656, filed Jul. 12, 2021, all of which are hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office (USPTO) patent file or records, but otherwise reserves all copyright rights whatsoever.

FIELD OF THE DISCLOSURE

The present disclosure relates to a portable launch assembly, and more particularly to apparatuses, systems, and methods of executing an operation for the portable launch assembly.

BACKGROUND

The need for authorizing or executing certain operations for portable launch systems in an operating environment is generally known, such as for example artillery equipment configured to mitigate avalanche activity in a mountainous terrain, or in some cases unmanned aerial vehicle (UAV) launches and/or landings in populous environments. While some methods of authorizing or executing an operation for the portable launch systems may be implemented through software systems enabling communication of one or more devices in a defined operating environment, such software systems are limited by industry-standard specifications. For example, to execute the operation for the portable launch system, the one or more devices must meet safety-critical standards, which are generally not implemented on electronic devices made available to a layperson (i.e., a consumer), such as a smart cellular device employing an Apple- or Android-based operating system (OS). These safety-critical standards are generally not met with conventional versions of the aforementioned electronic devices or equivalents thereof because the software, or other executable algorithm, effectuating the process of executing the operation are not independent of hardware or software natively provided for in these electronic devices. Accordingly, because of the lack of independence of the hardware or software natively provided for in these electronic devices, users (or autonomous systems) rely on electronic devices having specially configured hardware and software specifications that provide safety criticality and fail-safe execution.

Moreover, current methods of authorizing or executing the operation for the portable launch systems, even on electronic devices having specially configured hardware and software (as described above), fail to provide real-time feedback of operation approval, whether caused by significant delays in an operation-rejection feedback loop, or through communication errors leading to a failure to reject (or accept) operations for the portable launch system. These failures limit the one or more devices to advising whether to accept or to reject the operation for the portable launch system, but do not, or cannot, authorize an acceptance or a rejection of the operation, such that the operation for the portable launch system may execute the operation in a defined area. Accordingly, operation execution may be limited to an authorization by an entity, such as a centralized authority or hierarchical system, rather than the one or more devices configured to provide, define, and evaluate parameters of the operation.

Further, current methods of authorizing or executing the operation for the portable launch systems require detailed airspace control measures in the form of procedural controls to limit and regulate the operation and flow of air traffic. These procedural controls require separating airspace horizontally, vertically, or both into various control zones and corridors such that specific air vehicles may only pass through designated zones. Another current method for dealing with such airspace restrictions includes disengaging all portable launch systems within a potential area to allow an air vehicle to pass through and then re-engaging the portable launch systems once the air vehicle has passed through the airspace. These current methods fail to provide autonomous authorization for operation execution based on avoiding all potential collisions between launch objects from such launch systems and air vehicles occupying airspace over the potential area. Accordingly, the operation authorization and execution is limited by the mere presence and possibility of air vehicles in the airspace over the potential area. Thus, there is a need to provide apparatus, methods, or systems that overcome the foregoing limitations.

BRIEF SUMMARY

The present disclosure provides a novel portable launch assembly. Specifically, the present disclosure provides a novel method and system for executing an operation for the portable launch assembly.

Embodiments of apparatuses, methods, and systems of the present disclosure provide a solution to the shortcomings above. In one example, an operation authorization system may be provided comprising one or more electronic devices, at least one of the one or more electronic devices of which may be associated with one or more of the at least one portable launch assembly. The one or more electronic devices may be communicatively coupled to, and in association with, one another, thereby forming a secure network, such as a mobile ad-hoc network (MANET). Across the one or more electronic devices, signals representative of a situational awareness (SA), such as position location information (PLI) and/or position vector information (PVI), and operation parameters may be entered and received on the one more electronic devices vis-à-vis an electronic controller executing an operation approval unit. The operation approval unit may comprise at least three modules—an operation module, an airspace deconfliction module (AD), and a safety module—that operate independently of one another to define the operation for the at least one portable launch assembly, and to determine whether to authorize the operation for the at least one portable launch assembly. The operation module, the airspace deconfliction (AD) module, and the safety module of the operation approval unit may ensure that the operation authorization system may be implemented on one or more electronic devices generally available for commercial consumption (e.g., smart cellular devices), without compromising safety-criticality, fail-safe determination, and autonomous execution for the operation approval system.

In the context of authorizing and executing an operation for a portable launch assembly, certain embodiments of a method for authorizing and executing an operation for at least one portable launch assembly are disclosed. The at least one portable launch assembly may have a launch unit configured to be launched into an airspace over a potential area. An initial launch parameter set corresponding to an intended area located in a potential area may be provided to the launch unit. Based on an airspace collision avoidance status dynamically determinable over a maximum future time for consideration of the launch ($t_{max}$), the portable launch assembly may be provided authorization to launch the launch unit. Based on the authorization provided to the portable launch assembly and according to the initial launch parameter set, the launch unit may launch from the portable launch assembly. A second launch parameter set may be measured at the launch unit. The second launch parameter set and the initial launch parameter set may be compared at the launch unit to confirm an intended launch status of the launch unit. Also at the launch unit, the launch unit may be guided to the intended area.

In the context of authorizing an operation for a portable launch assembly, certain embodiments of a system for authorizing an operation for at least one portable launch assembly are disclosed. The at least one portable launch assembly may have a launch unit configured to be launched into an airspace over a potential area. One or more electronic devices may have a communication unit. The communication unit of the one or more electronic devices may be configured to communicatively couple each of the one or more electronic devices to one another such that each of the one or more electronic devices are in association with each other. The communication unit of the one or more electronic devices may be further configured to receive at least signals representative of a situational awareness (SA) corresponding to each of the one or more electronic devices. The one or more electronic devices may further have a safety module. The safety module of the one or more electronic devices may be configured to evaluate and either approve or reject the operation. The one or more electronic devices may further have an airspace deconfliction (AD) module. The airspace deconfliction (AD) module may be configured to recognize a maximum future time of consideration of a launch ($t_{max}$). The airspace deconfliction (AD) module may be further configured to receive and process signals representative of a situational awareness (SA) of each of the one or more electronic devices in order to determine one or more portable launch assemblies available for executing the operation based at least on the maximum future time of consideration of a launch ($t_{max}$). The airspace deconfliction (AD) module may be further configured to provide to the safety module portable launch assemblies that are available for launch.

In one particular and exemplary embodiment, a method for authorizing and executing an operation for at least one portable launch assembly is provided. The at least one portable launch assembly may have a launch unit configured to be launched into an airspace over a potential area. The method commences with providing, to a launch unit, an initial launch parameter set that corresponds to an intended area located in a potential area. The method continues with providing an authorization for the at least one portable launch assembly to launch the launch unit. The authorization is based at least on a status of airspace collision avoidance, which is dynamically determinable over a time period that represents the maximum amount of future time to be considered for launching the launch unit—represented by ($t_{max}$). Based upon the authorization that has been provided to the launch unit, the method continues with launching the launch unit from the at least one portable launch assembly where the launch is according to the initial launch parameter set. The method continues with measuring, at the launch unit, a second launch parameter set. At the launch unit, the method also continues with confirming an intended launch status of the launch unit by comparing the second launch parameter set to the initial launch parameter set. The further continues with, at the launch unit, guiding the launch unit to the intended area.

In another exemplary aspect according to the above-referenced embodiment, the step of providing authorization to the at least one portable launch assembly further includes receiving signals representative of a class of the launch unit, signals representative of a class of an air vehicle, signals representative of a situational awareness (SA) of the launch vehicle, and signals representative of a situational awareness (SA) of the air vehicle. The step of providing authorization to the at least one portable launch assembly also includes determining future position areas of the launch unit and the air vehicle based at least on the signals representative of class of the launch unit and the air vehicle, the signals representative of the situational awareness (SA) of the launch unit and the air vehicle, and the maximum future time of launch consideration ($t_{max}$).

In another exemplary aspect according to the above-referenced embodiment, the step of receiving class information of the launch unit further includes receiving a maximum $\Delta V$ and a maximum glide ratio of the launch unit. The step of determining future position areas of the launch unit further includes determining future position areas based on at least one potential malfunction status of the launch unit, determining future position areas based on a maximum flight path of the launch unit, and superimposing future position areas based on at least one potential malfunction status and a maximum flight path of the launch unit.

In another exemplary aspect according to the above-referenced embodiment, the step of receiving class information of the air vehicle may further include receiving a maximum velocity of the air vehicle. The step of receiving signals representative of the situational awareness (SA) of the air vehicle may further include receiving signals representative of a time when the signals representative of the situational awareness (SA) of the air vehicle were reported and signals representative of a last reported velocity ($V_{last}$). According to the steps of receiving class information and signals representative of the situational awareness (SA) of the air vehicle, the method may further include determining future position areas of the air vehicle based further on at least one of the maximum velocity of the air vehicle, the time when the signals representative of the situational awareness (SA) of the air vehicle were reported, and the last reported velocity ($V_{last}$).

In another exemplary aspect according to the above-referenced embodiment, the step of receiving signals representative of situational awareness (SA) of the air vehicle may occur once every 1 to 10 seconds.

In another exemplary aspect according to the above-referenced embodiment, the step of confirming the intended launch status may occur within two (2) seconds of launching the launch unit.

In another exemplary aspect according to the above-referenced embodiment, the step of confirming the intended launch status of the launch unit may further include generating a processed signal based at least on the compared launch parameter sets and may include disarming the launch unit in the absence of the processed signal.

In another exemplary aspect according to the above-referenced embodiment, the method may further include, at the launch unit, deploying at least one wing and at least one fin based on a confirmed intended launch status.

In another exemplary aspect according to the above-referenced embodiment, the second launch parameter set may further include at least one of heat, shock, light, static electricity, spin, acceleration, air pressure, or time elapsed since launch.

In another exemplary aspect according to the above-referenced embodiment, the second launch parameter set may further include a sequence of second launch parameter set.

In another exemplary aspect according to the above-referenced embodiment, the method may further include the steps of capturing at least one image of the intended area at the launch unit. The step of providing an initial launch parameter set to the launch unit may further include providing an initial image of the intended area. The step of guiding the launch unit to the intended area may further include comparing the at least one captured image of the intended area to the initial image of the intended area.

In another exemplary aspect according to the above-referenced embodiment, the one or more electronic devices may correspond to at least one air vehicle and the at least one portable launch assembly.

In another exemplary aspect according to the above-referenced embodiment, the signals representative of a situational awareness (SA) may include at least one of position location information (PLI) or position vector information (PVI).

In another exemplary aspect according to the above-referenced embodiment, the communication unit of the electronic device corresponding to at least one portable launch assembly may be further configured to create an airplane object based at least on signals representative of situational awareness (SA) corresponding to each of the one or more electronic devices corresponding to at least one air vehicle, and create a launcher object corresponding to each of the one or more electronic devices corresponding to at least one portable launch assembly.

In another exemplary aspect according to the above-referenced embodiment, the launch unit may further include an initiator configured to sense launch information of the launch unit and a controller operatively coupled to the initiator. The controller may be configured to compare the launch information to at least one predetermined launch threshold and generate a processed signal based at least on the comparison of the launch information to the launch threshold.

In another exemplary aspect according to the above-referenced embodiment, the launch unit may further include a launch frame, the launch frame may include at least one of each of a deployable wing and fin for guiding the launch unit. The controller may be operatively coupled to the deployable wing and fin for guiding the launch unit, and the controller may be further configured to deploy the deployable wing and fin for guiding the launch unit based at least on the processed signal.

In another exemplary aspect according to the above-referenced embodiment, the launch information may further include at least one of heat, shock, light, static electricity, spin, acceleration, air pressure, or time elapsed since launch.

In another exemplary aspect according to the above-referenced embodiment, the launch unit may further include a launch frame, the launch frame including at least one deployable wing. The one or more of the at least one of the deployable wing may further include a camera. The launch frame may further include at least one deployable and movable fin, and a controller operatively coupled to wing, fin, and camera.

In another exemplary aspect according to the above-referenced embodiment, the controller may be configured to recognize an initial image of an intended area, the intended area located within the potential area, and cause the camera to capture an image of the intended area. The controller may be further configured to compare the captured image to the initial image, establish a trajectory based at least on the compared images, and move the at least one fin based at least on the established trajectory.

Unless otherwise defined, all technical and scientific terms used herein have the same meaning as commonly understood by one of ordinary skill in the art to which this invention belongs. Any invention as disclosed herein may be embodied in other specific forms without departing from the spirit or essential attributes thereof, and it is therefore desired that embodiments be considered in all aspects as illustrative and not restrictive. Any headings utilized in the description are for convenience only and no legal or limiting effect. Numerous objects, features, and advantages of the embodiments set forth herein will be readily apparent to those skilled in the art upon reading of the following disclosure when taken in conjunction with the accompanying drawings.

BRIEF DESCRIPTION OF THE DRAWINGS

Hereinafter, various exemplary embodiments of the disclosure are illustrated in more detail with reference to the drawings.

DETAILED DESCRIPTION

Figure 1A:
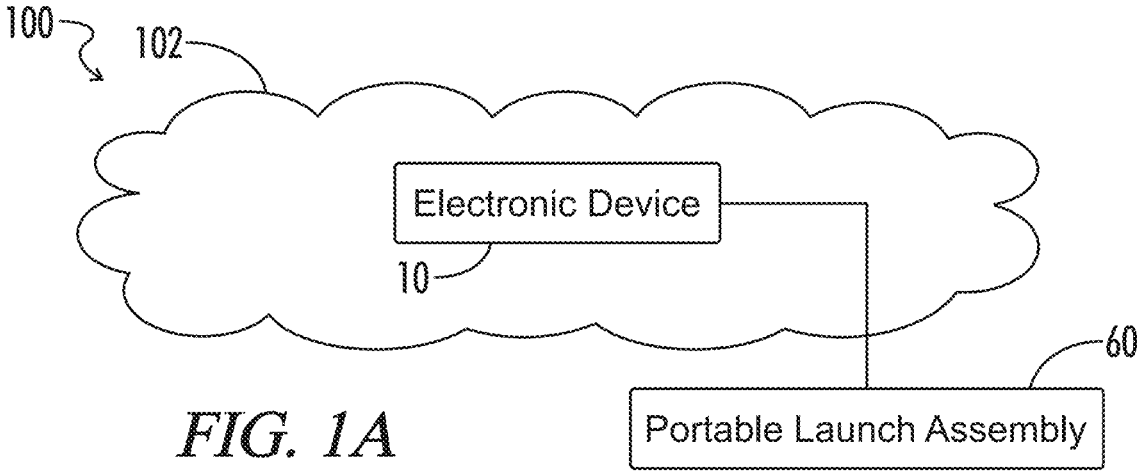
FIGS. 1A-1C illustrate exemplary embodiments of a partial diagram of a system for authorizing an operation for at least one portable launch assembly, the system comprising one or more electronic devices in communicative coupling to, and in association with, one another, in accordance with aspects of the present disclosure.

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure. Referring generally to FIGS. 1-13, various exemplary embodiments may now be described of apparatuses, systems, and methods for authorizing and executing an operation for at least one portable launch assembly 60. Where the various figures describe embodiments sharing various common elements and features with other embodiments, similar elements and features are given the same reference numerals and redundant description thereof may be omitted below.

Figure 1B:
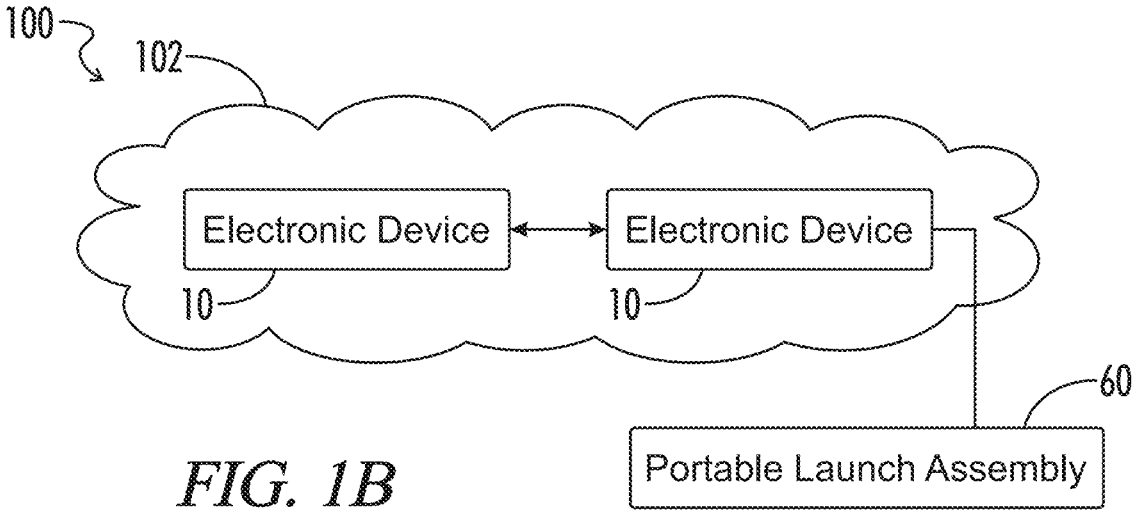
Figure 1C:
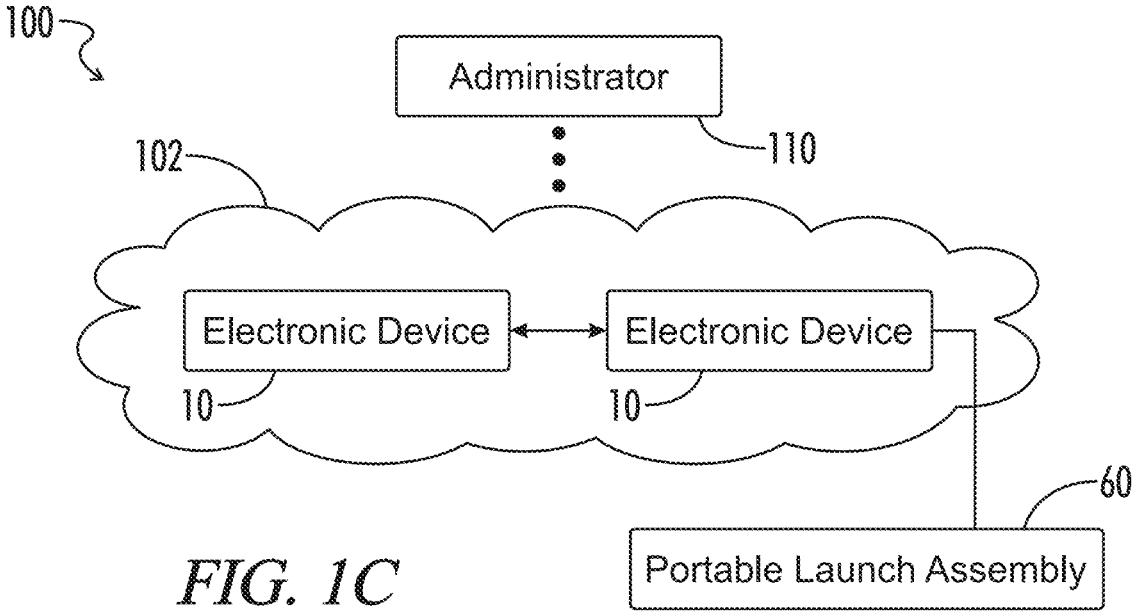

FIGS. 1A-1C illustrate an exemplary embodiment of a partial diagram of a system 100 for authorizing an operation for at least one portable launch assembly 60, the operation authorization system 100 comprising one or more electronic devices 10. The one or more electronic devices 10, such as one or more user devices 10, may be associated with one or more of the at least one portable launch assembly 60, the at least one portable launch assembly 60 having a launch unit 70 configured to be launched from a surface to an airspace, and subsequently onto or against an intended area 134 in a potential area 120, as illustratively conveyed in FIG. 10. In optional embodiments, the launch unit 70 may comprise at least one of an unmanned aerial vehicle (UAV), such as a drone, that is configured to deliver at least one article, such as various goods and products (e.g., household goods, groceries, packages, and other items) at remote or distant locations within the potential area 120. In other operational embodiments, the launch unit 70 may comprise projectiles configured to be fired from artillery equipment onto, or against, a mountainous terrain, for the purpose of mitigating avalanche activity, as illustratively conveyed in FIG. 10, and as further described herein. The potential area 120 may comprise any geographic or regional territory or zone wherein the launch unit 70 may be configured to be launched into the airspace. The potential area 120 may comprise a number of areas or zones within the potential area 120, including one or more non-landing sites 142 and one or more landing sites 140, the one or more landing sites 140 of which may comprise the intended area 142. In other embodiments, the at least one portable launch assembly 60 may constitute the launch unit 70, e.g., an unmanned aerial vehicle (UAV), such as a drone; and, in other optional embodiments, the launch unit 70 may be fired separately and apart from the at least one portable launch assembly 60, e.g., projectiles fired from artillery equipment, for the purpose of mitigating avalanche activity in a mountainous terrain. The term "potential area" is intended to broadly encompass and convey a geographic territory or region that may contain or encompass areas, sites, or zones that may be suitable for impact or landing (e.g., the one or more landing sites 140) and areas, sites, or zones that may not be suitable for impact or landing (e.g., the one or more non-landing sites 142).

Referring to FIG. 1A, the system 100 may comprise one of one or more electronic devices 10, the one of the one or more electronic devices 10 in association with the at least one portable launch assembly 60, and the one or more electronic devices 10 establishing a secure network 102. The secure network 102 may comprise a closed network 102 comprising only the one of the one or more electronic devices 10, the closed network 102 having the capability of recruiting and/or accepting another of the one or more electronic devices 10 into the closed network 102, such as by and through authentication keys or access credentials. Referring to FIG. 1B, the system 100 may comprise a plurality of the one or more electronic devices 10, wherein at least one of the one or more electronic devices 10 is associated with one or more of the at least one portable launch assembly 60. The plurality of the one or more electronic devices 10 may be communicatively coupled to one another vis-à-vis a communication unit 14 (as further described herein), such that each of the one or more electronic devices 10 are communicatively associated with one another. The plurality of the one or more electronic devices 10 may establish, or form, the secure network 102 when the one or more electronic devices 10 are communicatively coupled to, and in association with, one another. Referring to FIG. 1C, the system 100 may comprise a plurality of the one or more electronic devices 10, wherein at least one of the one or more electronic devices 10 is associated with the one or more of the at least one portable launch assembly 60. The one or more electronic devices 10 communicatively coupled to, and in association with, one another may be recruited or accepted to the secure network 102 by an administrator 110.

The administrator 110 may comprise another of the one or more electronic devices 10, or the administrator may comprise a server, a centralized host, or the like, capable of providing and/or maintaining the secure network 102 for the one or more electronic devices 10. For the purpose of the disclosure herein, the system 100 may authorize the operation for the at least one portable launch assembly 60 vis-à-vis any of the one or more electronic devices 10 or the administrator 110, and combinations thereof.

Figure 2:
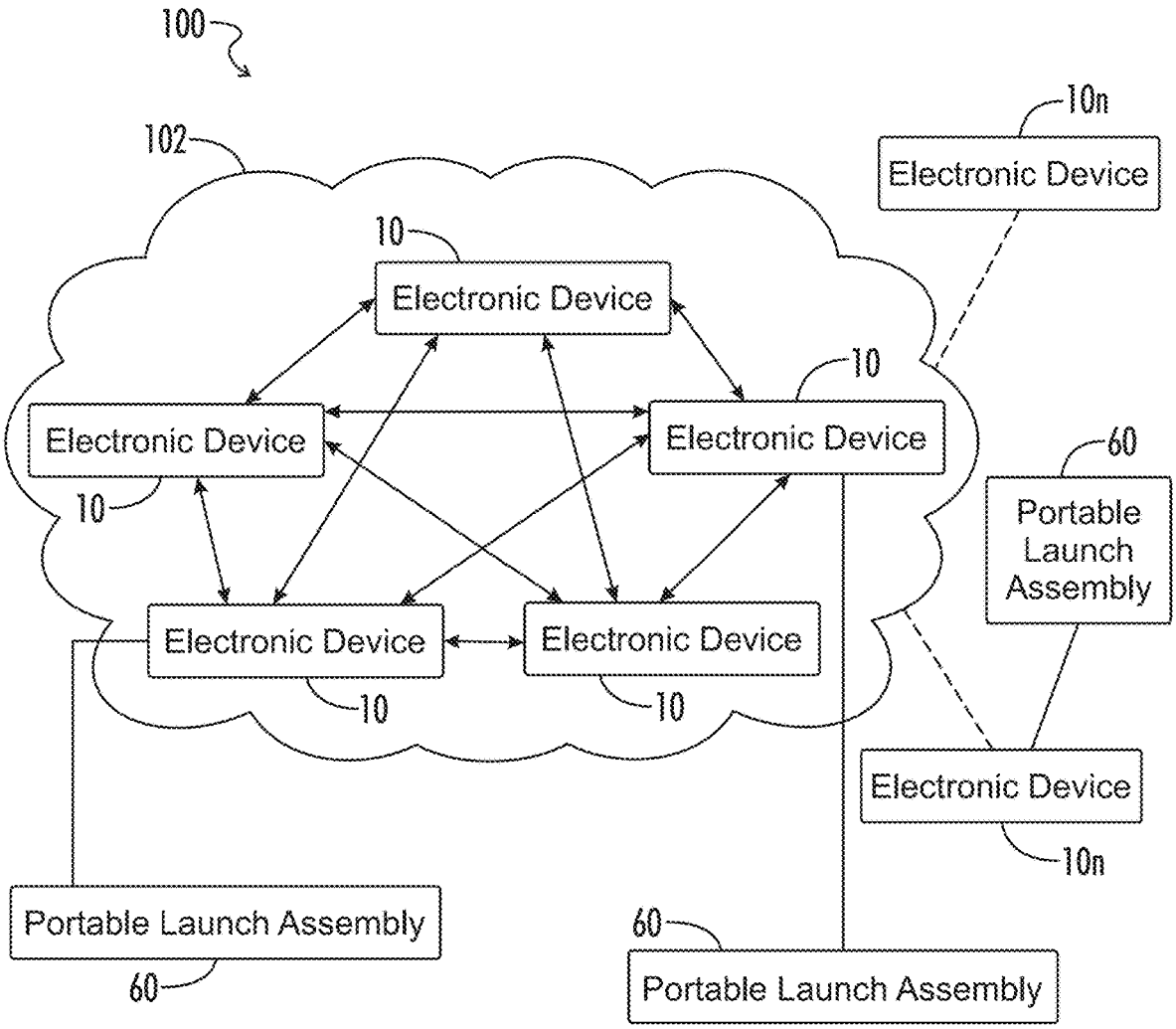
FIG. 2 illustrates an exemplary embodiment of a partial network diagram of a system for authorizing an operation for at least one portable launch assembly, in accordance with aspects of the present disclosure.

FIG. 2 illustrates an exemplary embodiment of a partial network diagram of the system 100 for authorizing the operation for at least one portable launch assembly 60. The system 100 may comprise a plurality of the one or more electronic devices 10 communicatively coupled to, and in association with one another, wherein at least one of the one or more electronic devices 10 is associated with one or more of the at least one portable launch assembly 60. The communicatively coupling and association of the one or more electronic devices 10 may form, or establish, the secure network 102, including by and through wired or wireless communication (e.g., cellular communication). The secure network 102 may be configured to recruit other of the one or more electronic devices 10*n*, whether by and through any one (or more) of the one or more electronic devices 10 or through the administrator 110, or a combination of the foregoing. One or more of the at least one portable launch assembly 60 may be associated with any of the one or more electronic devices 10*n* recruited to the secure network 102.

Figure 4:
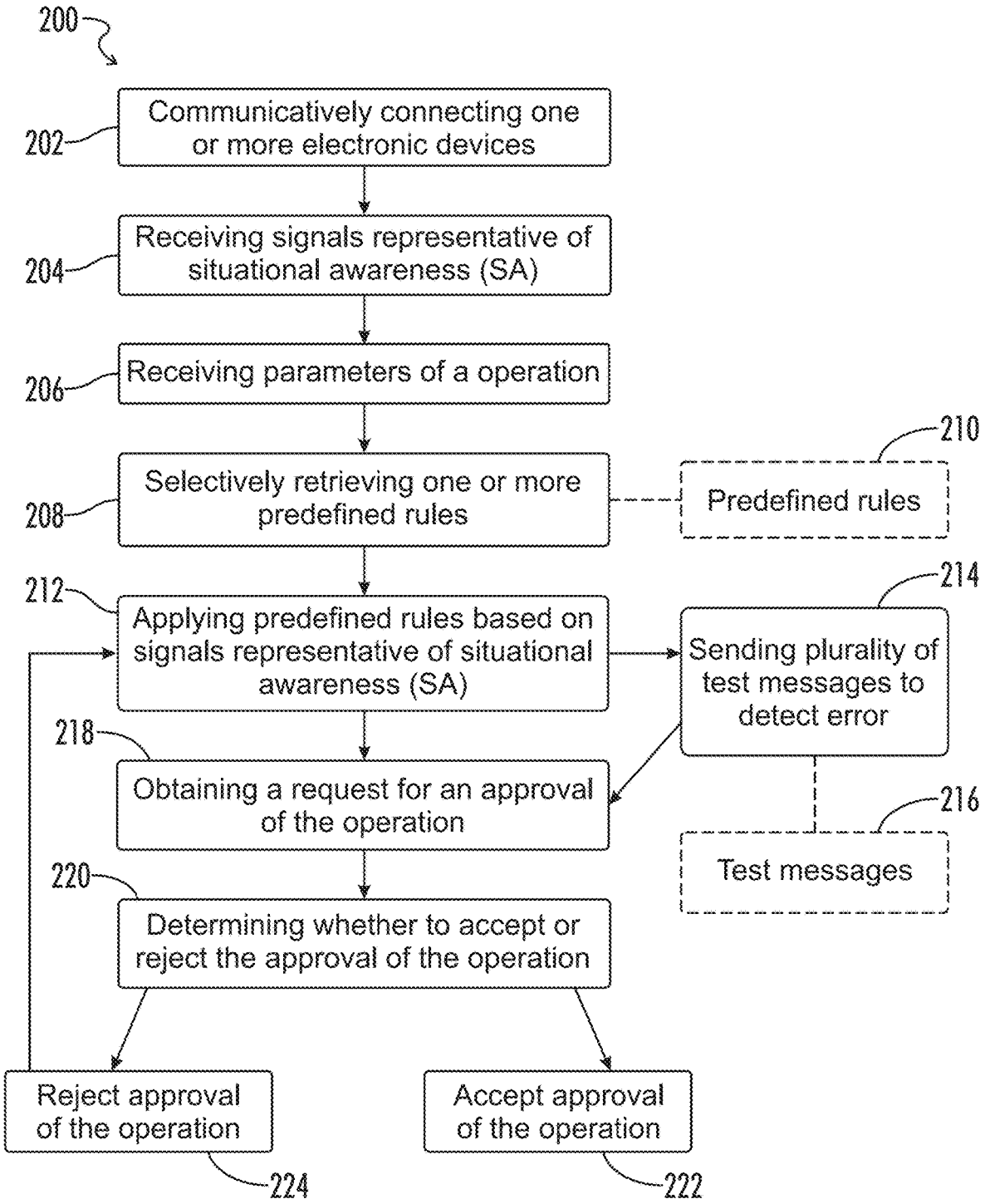
FIG. 4 illustrates a flowchart providing an exemplary embodiment of a method for authorizing an operation for at least one portable launch assembly, in accordance with aspects of the present disclosure.
Figure 10:
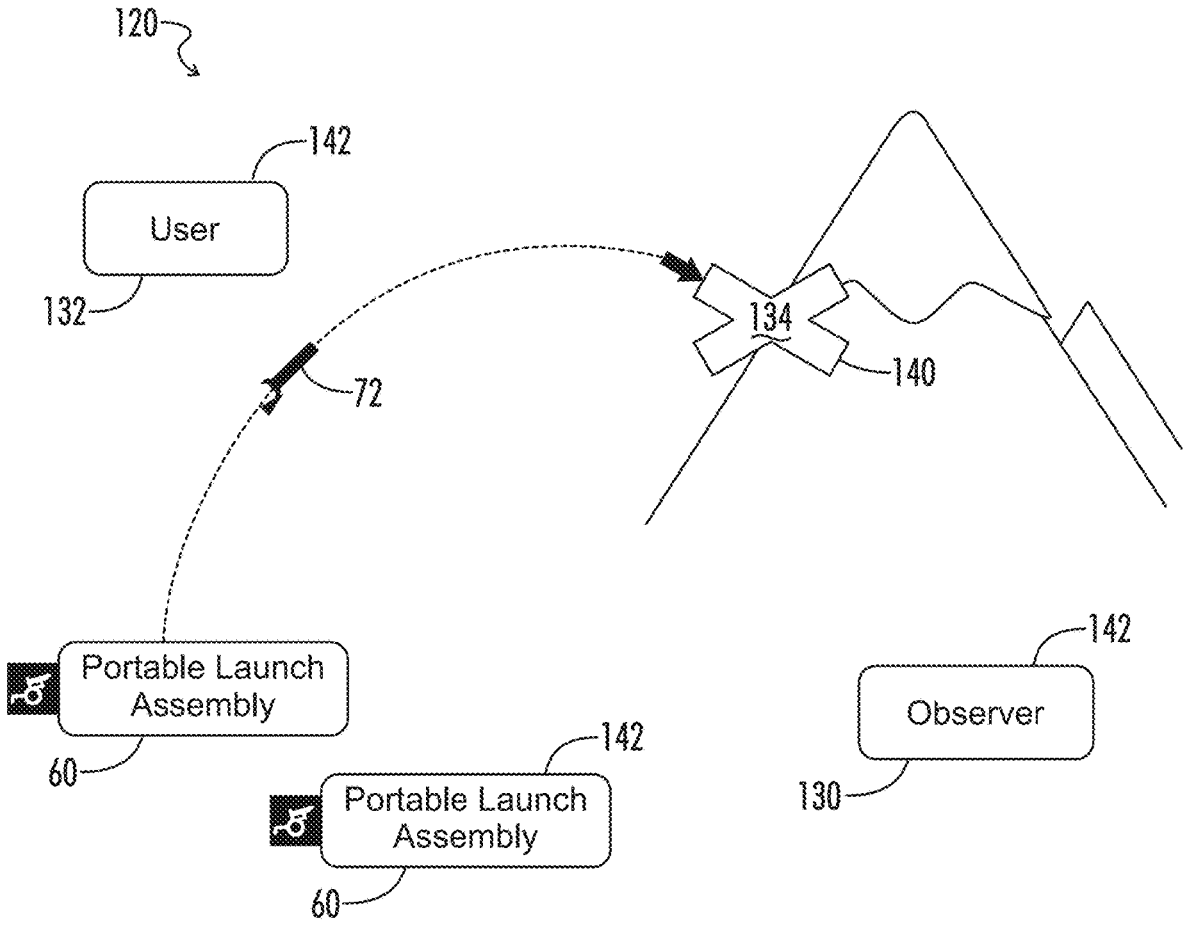
FIG. 10 illustrates an exemplary embodiment of a system for authorizing an operation for at least one portable launch assembly in a potential area, the at least one portable launch assembly comprising artillery equipment configured to mitigate avalanche activity in the potential area, in accordance with aspects of the present disclosure.

As depicted in FIGS. 1A, 1B, 1C, and 2, the system 100 may comprise the one or more electronic devices 10 communicatively coupled to, and in association with, one another in a given area, such as the potential area 120 (as exemplarily illustrated in FIG. 10). Within the secure network 102, the one or more electronic devices 10 of the system 100 may function in accordance with a method 200, as depicted in FIG. 4 and discussed further herein, either alone (e.g., independently), or in concert with one another, such that the one or more electronic devices 10 of the system 100 function as decentralized or distributed nodes in the secure network 102. Where the one or more electronic devices 10 act in concert with one another, each of the one or more electronic devices 10 may act as nodes to relay, transmit, and/or exchange communications, inputs (e.g., operation parameters), or data among the one or more electronic devices 10 in the system 100. As shown in FIGS. 1A, 1B, 1C, and 2, directional arrows convey the communicative couplings, and associations, of the one or more electronic devices 10 of the system 100, wherein at least one of the one or more electronic devices 10 is associated with one or more of the at least one portable launch assembly 60. In optional embodiments of the system 100, each of the one or more electronic devices 10 may be communicatively coupled to, and in association with, one another, as well as the administrator 110. The administrator 110 may comprise another network of devices, such as another of the secure network 102, or the administrator 110 may include a master administrator with one or more slave administrators, wherein each of the master administrator or the one or more slave administrators may be communicatively coupled to, and in association with, the one or more electronic devices 10. In other optional embodiments, the secure network 102 may comprise a mobile ad-hoc network (MANET) or a wireless mesh network (WMN). In embodiments where the secure network 102 comprises a mobile ad-hoc network (MANET) or a wireless mesh network (WMN), the one or more electronic devices 10 may be communicatively coupled to, and in association with, one another based upon geographical or physical proximity within the potential area 120. Other of the one or more electronic devices 10, one or more of which may be associated with one or more of the at least one portable launch assembly 60 and/or associated launch unit 70, may be recruited or accepted by the secure network 102 when the one or more electronic devices 10 are moved within a geographical proximity or physical range of the then-existing secure network 102 of the one or more electronic devices 10. Other of the one or more electronic devices 10, one or more of which may be associated with one or more of at least one air vehicle 150 may be recruited or accepted by the secure network 102 when the one or more electronic devices 10 are moved within a geographical proximity or physical range of the then-existing secure network 102 of the one or more electronic devices 10.

Figure 3A:
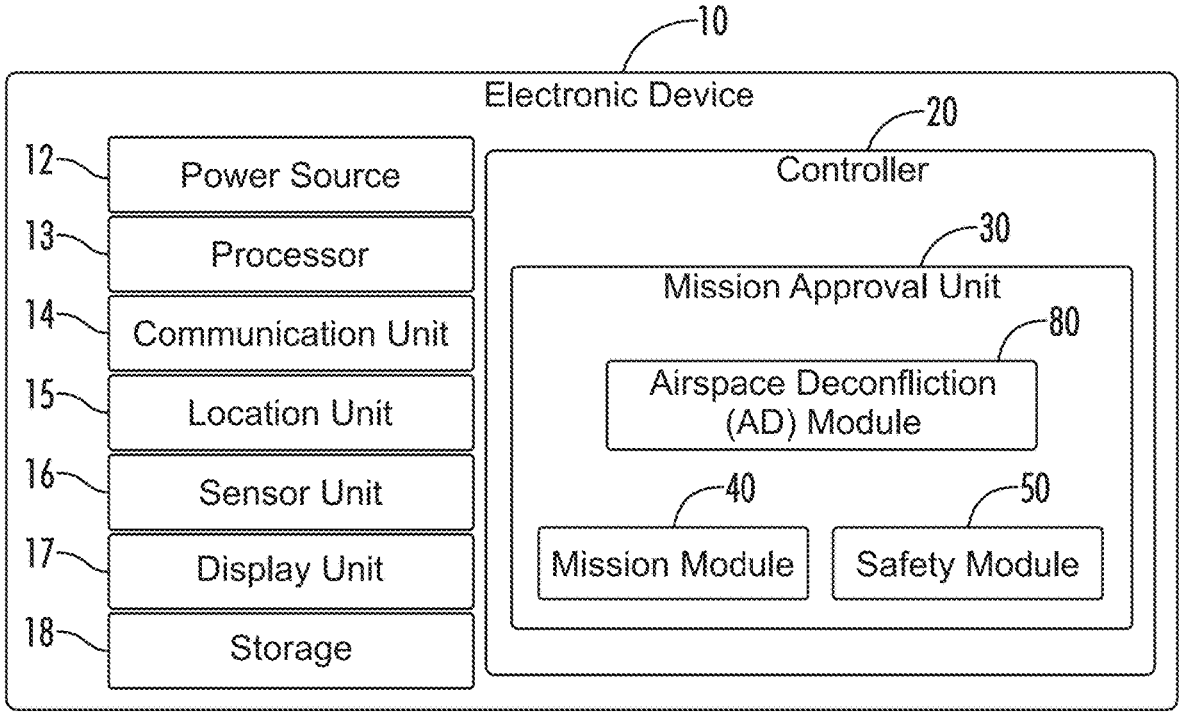
FIG. 3A illustrates an exemplary embodiment of a partial block diagram of an electronic device, in accordance with aspects of the present disclosure.
Figure 3B:
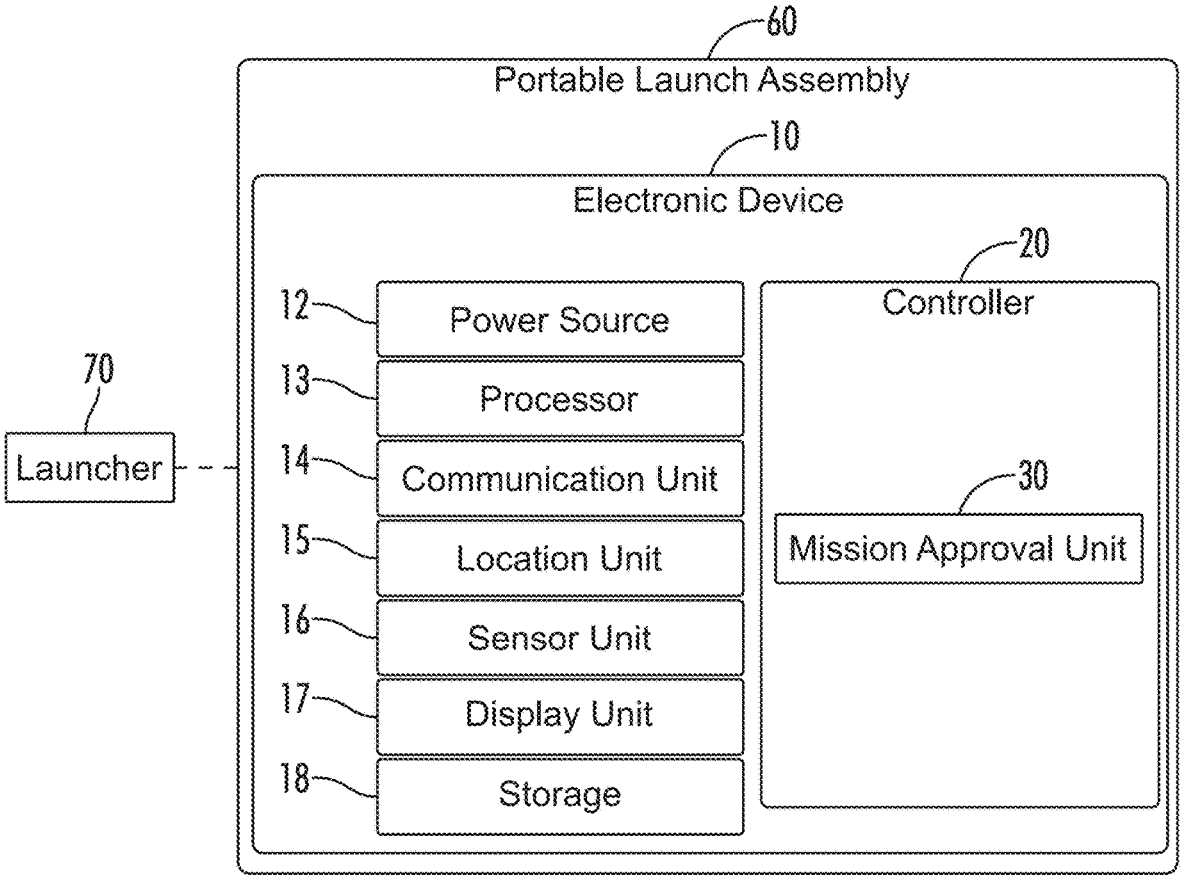
FIG. 3B illustrates an exemplary embodiment of a partial block diagram of the electronic device in association with a portable launch assembly, in accordance with aspects of the present disclosure.

FIGS. 3A-3B depict an exemplary embodiment of the electronic device 10, wherein one of the one or more electronic devices 10 may be associated with at least one portable launch assembly 60 having the launch unit 70. Any of the one or more electronic devices 10 may be lightweight, portable, and/or rugged, and may preferably be a hand-held computer, such as a personal data assistant (PDA), cellular phone, or a smart cellular device, including a smart cellular device or portable computer employing an Android-based operating system (OS), an Apple-based OS, or a Linux-based OS. In optional embodiments, any of the one or more electronic devices 10 may be portable laptop computer, or a notebook- or tablet-type computer. In optional embodiments, any or the one or more electronic devices 10 may be a radio device that includes a radio receiver and a radio transmitter or may otherwise be a wireless communication device configured to transfer information between two or more points without the use of an electrical conductor, optical fiber, or other continuous guided medium for the transfer. The electronic device 10 may include one or more of a power source 12, a processor 13, a communication unit 14, a location unit 15, a sensor unit 16, a display unit 17, a storage (or a storage medium) 18, and a controller 20 configured to execute an operation approval unit 30. The power source 12, which drives operability of the one or more electronic devices 10, may include at least one of a modular battery, a battery backup, an uninterrupted power supply (UPS), or any battery commercially provided in connection with a smart cellular device or portable computer employing an Apple-based OS, an Android-based OS, or a Linux-based OS, or the like. The processor 13 may be a generic hardware processor, a special-purpose hardware processor, or a combination thereof. In embodiments having a generic hardware processor (e.g., as a central processing unit (CPU) available from manufacturers such as Intel and AMD), the generic hardware processor is configured to be converted to a special-purpose processor by means of being programmed to execute and/or by executing a particular algorithm in the manner discussed herein, e.g., the method 200, for providing a specific operation or result. It should be appreciated that the processor 13 may be any type of hardware and/or software processor and is not strictly limited to a microprocessor or any operation(s) only capable of execution by a microprocessor, in whole or in part.

The communication unit 14 of the one or more electronic devices 10 may be configured to permit communication—for example via the secure network 102, as depicted in FIGS. 1A, 1B, 1C, and 2—by a wired interface, wireless interface, or a combination thereof. In optional embodiments, the communication unit 14 may include wireless communication components, such as cellular modem, radio waves, Wi-Fi, or Bluetooth, and combinations thereof. In other embodiments, the communication unit 14 may include a transceiver (not shown), or other two-way radio, which may be functionally linked to the controller 20, the transceiver (not shown) configured to send and receive communications vis-à-vis radio waves, such as among the one or more electronic devices 10 or between the one or more electronic devices 10 and a communication section associated with the at least one portable launch assembly 60 and/or the launch unit 70. The communication unit 14 may enable the one or more electronic devices 10 to communicatively couple to, and associate with, one another, or in optional embodiments, the administrator 110. The communication unit 14 may also be functionally communicable with other aspects of the one or more electronic devices 10, including the location unit 15 and the sensor unit 16. In optional embodiments, the communication unit 14 of the one or more electronic devices 10 may include a radio-frequency (RF) unit, which may comprise an antenna configured to transmit single- or multi-directional signals to other RF units in the communication unit 14 of the other of the one or more electronic devices 10.

The location unit 15 of the one or more electronic devices 10 may include a global positioning system (GPS) unit (not shown), the GPS unit (not shown) configured to provide location data of the one or more electronic devices 10, the at least one portable launch assembly 60, and/or the launch object 70, wherein one of the one or more electronic devices 10 is associated therewith. Such location data may correspond to position location information (PLI) and/or position vector information (PVI) of the one or more electronic devices 10, particularly the PLI and/or PVI of the one or more electronic devices 10 in the potential area 120. In optional embodiments, the location unit 15 may additionally or alternatively include an inertial navigation system (INS) unit (not shown) configured to allow the controller to determine the location of at least one of the one or more electronic devices 10, the launch unit 70, and the air vehicle 150. The sensor unit 16 of the one or more electronic devices 10 may comprise a number of sensors, such as inertial measurement units (IMUs). In optional embodiments, the IMUs may include a number of sensors including, but not limited to, accelerometers, which measure (among other things) velocity and acceleration, gyroscopes, which measure (among other things) angular velocity and angular acceleration, magnetometers, which measure (among other things) strength and direction of a magnetic field, and any or more of a temperature sensor, a shock or impact sensor, a photodetector, an electrostatic sensor, an air pressure sensor, or a clock, timer, or sensor otherwise used to measure elapsed or absolute time. In optional embodiments, directional data provided by the location unit 15, or position-based data provided by the sensor unit 16, may be merged (or otherwise used in combination) by the controller 20 to ascertain a location or motion of the one or more electronic devices 10 (and any of the at least one portable launch assembly 60 associated therewith) in the potential area 120.

The one or more electronic devices 10 may store one or more sets of instructions, including instructions corresponding to the method 200, in the storage 18, which may be either volatile or non-volatile. The one or more sets of instructions, including instructions corresponding to the method 200, may be configured to be executed by the processor 13 to perform at least one operation corresponding to the one or more sets of instructions. The one or more electronic devices 10 may also have a display unit 17 as part of a user interface (UI), which may include one or more UI tools, such as a keyboard, joystick, toggle, or other tool, which are configured to enable input of instructions to the controller 20, including parameters of the operation, as further described herein.

The one or more electronic devices 10 may be a standalone device (as described previously) or may be used with at least one external component, such as another of the one or more electronic devices 10 or the administrator 110, either locally or remotely communicatively couplable with the one or more electronic devices 10—for example via the secure network 102, as depicted in FIGS. 1A, 1B, 1C, and 2. The one or more electronic devices 10 may be configured to store, access, or provide at least a portion of information usable to permit one or more operations described herein, including operations set forth in the method 200, and as illustratively conveyed in FIGS. 4-6. Alternatively, or in addition, the one or more electronic devices 10 may be configured to store content data and/or metadata to enable one or more operations described herein.

FIG. 4 illustrates a flowchart providing an exemplary embodiment of the method 200 of authorizing an operation for the at least one portable launch assembly 60, in accordance with aspects of the present disclosure. The method 200 may commence with an operation 202 of communicatively connecting, by and through the communication unit 14, the one or more electronic devices 10 with one another, such that each of the one or more electronic devices 10 are in association with one another. In optional embodiments, the operation 202 of the method 200 may further continue by establishing the secure network 102 when the one or more electronic devices 10 are communicatively coupled to, and in association with, one another, as illustratively conveyed in FIGS. 1A, 1B, 1C, and 2. In other optional embodiments, the one or more electronic devices 10 communicatively coupled to, and in association with, one another may be recruited to the secure network 102 by another of the one or more electronic devices 10 or by a remote system, such as the administrator 110. In further optional embodiments, one or more electronic devices 10 may be communicatively connected to one another, wherein at least one of the one or more electronic devices 10 may be associated with at least one portable launch assembly 60. As described previously, the secure network 102 may comprise a mobile ad-hoc network (MANET) or a wireless mesh network (WMN).

Figure 9:
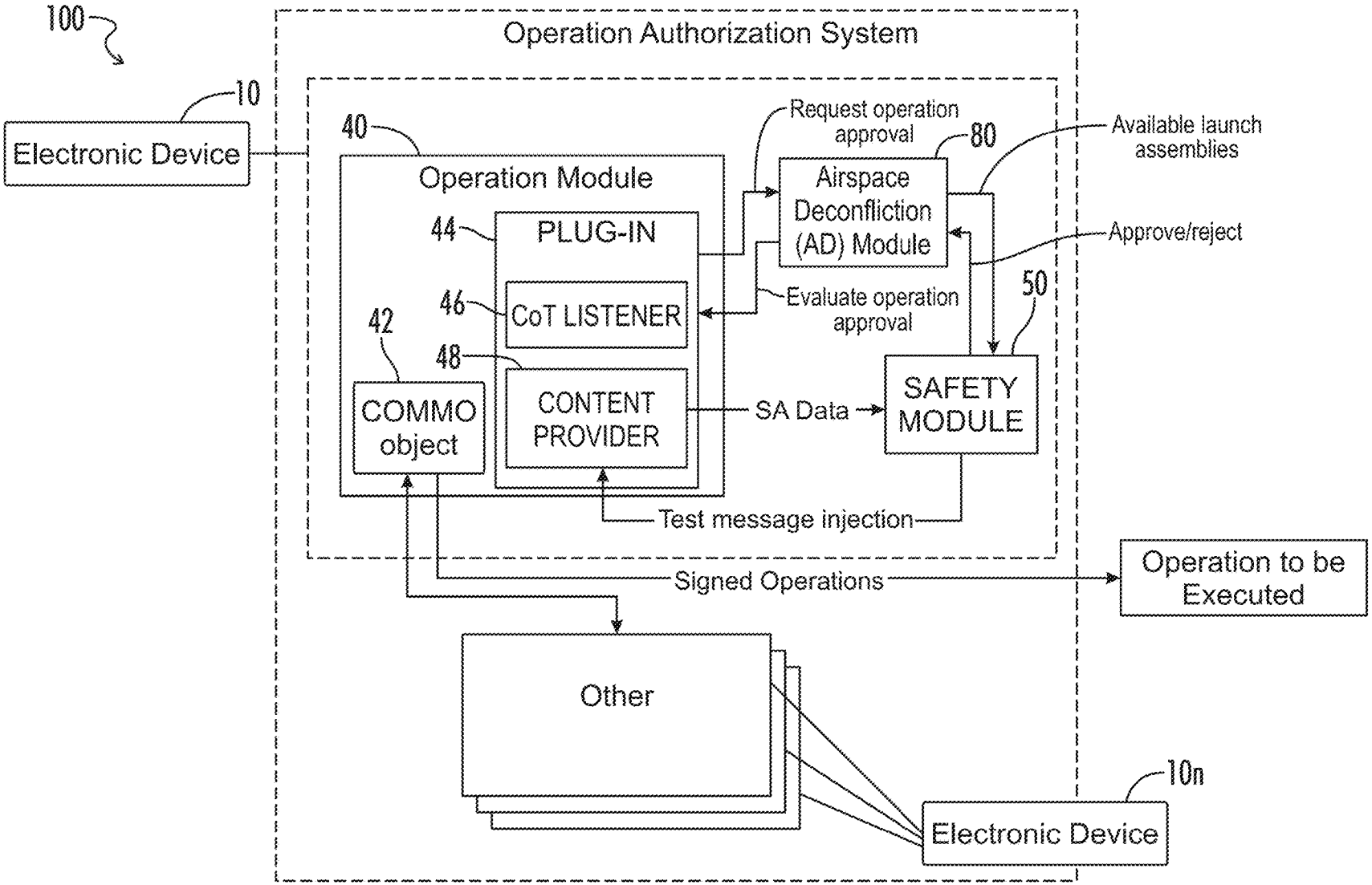
FIG. 9 illustrates another exemplary embodiment of a partial block diagram of a system for authorizing an operation for at least one portable launch assembly, the system comprising one or more electronic devices having a safety module and an operation module, in accordance with aspects of the present disclosure.

The method 200 may continue with an operation 204 of receiving at least signals representative of a situational awareness (SA) corresponding to each of the one or more electronic devices 10, including those of the one or more electronic devices 10 associated with the at least one portable launch assembly 60 and/or the launch object 70. The signals representative of the situational awareness (SA) may be received and outputted by the location unit 15 and/or the sensor unit 16 to the controller 20, the location unit 15 and/or the sensor unit 16 of which may be couplable to the communication unit 14 (as described above). For the purpose of the disclosure herein, signals representative of a situational awareness (SA) may include (without limitation) position location information (PLI) and/or position vector information (PVI) of the one or more electronic devices 10, or any directional-, position-, or movement-related information pertaining to the one or more electronic devices 10 (including those associated with the at least one portable launch assembly 60 and/or the launch object 70). Situational awareness (SA) may also encompass environmental factors or other external conditions pertaining to, or affecting, the one or more electronic devices 10 and/or the potential area 120, including any perception or monitoring of an observer 130, a user 132, or the intended area 134 in the potential area 120, as illustratively conveyed in FIG. 10. As depicted in FIG. 9, the signals representative of the situational awareness (SA) may be received, on or though the communication unit 14, by a communication (or "COMMO") object 42 provided by the operation module 40 of the operation approval unit 30, executable by the controller 20. The COMMO object 42 may use device-specific libraries residing on the one or more electronic devices 10, for the purpose of sending the information corresponding to the situational awareness (SA) of the one or more electronic devices 10 to a plug-in 44, or other software application 44, downloadable and implementable by the one or more electronic devices 10. The plug-in 44 may include a cursor-on-target (CoT) Listener 46, the CoT Listener 46 of which may be configured to filter the information corresponding to the situational awareness (SA) of the one or more electronic devices 10 (or information corresponding to the network 102).

The operation 204 of receiving at least signals representative of a situational awareness (SA) may additionally include an operation of receiving signals representative of a class of the launch unit 70 and/or an air vehicle 150. In optional embodiments, the operation of receiving signal representative of a class may comprise receiving signals representative of a class associated with a number of the one or more electronic devices, including those associated with the at least one portable launch assembly 60, the launch unit 70, and/or the air vehicle 150. Signals representative of a class, otherwise indicated herein as class information, may include information defining a particular class of an object or the one or more electronic devices 10 according to one or more categories. The one or more categories of class information may include at least an air vehicle, a launcher, an electronic device associated with a user, with an observer, and/or an administrator, and may further included any number of a specific subcategory of each class. Signals representative of class information may include information defining a set of physical parameters associated with each class or subcategory of each class. For example, class information associated with the at least one portable launch assembly 60 and/or the launch unit 70 may indicate the physical limitations associated with each of the at least one portable launch assembly 60 and/or the launch unit 70, including all possible trajectory information. As an example, class information associated with the at least one air vehicle 150 may indicate operating parameters of the air vehicle 150, including maximum vertical speed, maximum attainable velocity, thrust/weight ratio, and any other information associated with the physical operating parameters of the at least one air vehicle 150. As depicted in FIG. 9, the signals representative of the situational awareness (SA) may be received, on or though the communication unit 14, by a communication (or "COMMO") object 42 provided by the operation module 40 of the operation approval unit 30, executable by the controller 20. The COMMO object 42 may use device-specific libraries residing on the one or more electronic devices 10, for the purpose of sending the information corresponding to the class of the one or more electronic devices 10 to a plug-in 44, or other software application 44, downloadable and implementable by the one or more electronic devices 10. The plug-in 44 may include a cursor-on-target (CoT) Listener 46, the CoT Listener 46 of which may be configured to filter the information corresponding to the class of the one or more electronic devices 10 (or information corresponding to the network 102).

Figure 8:
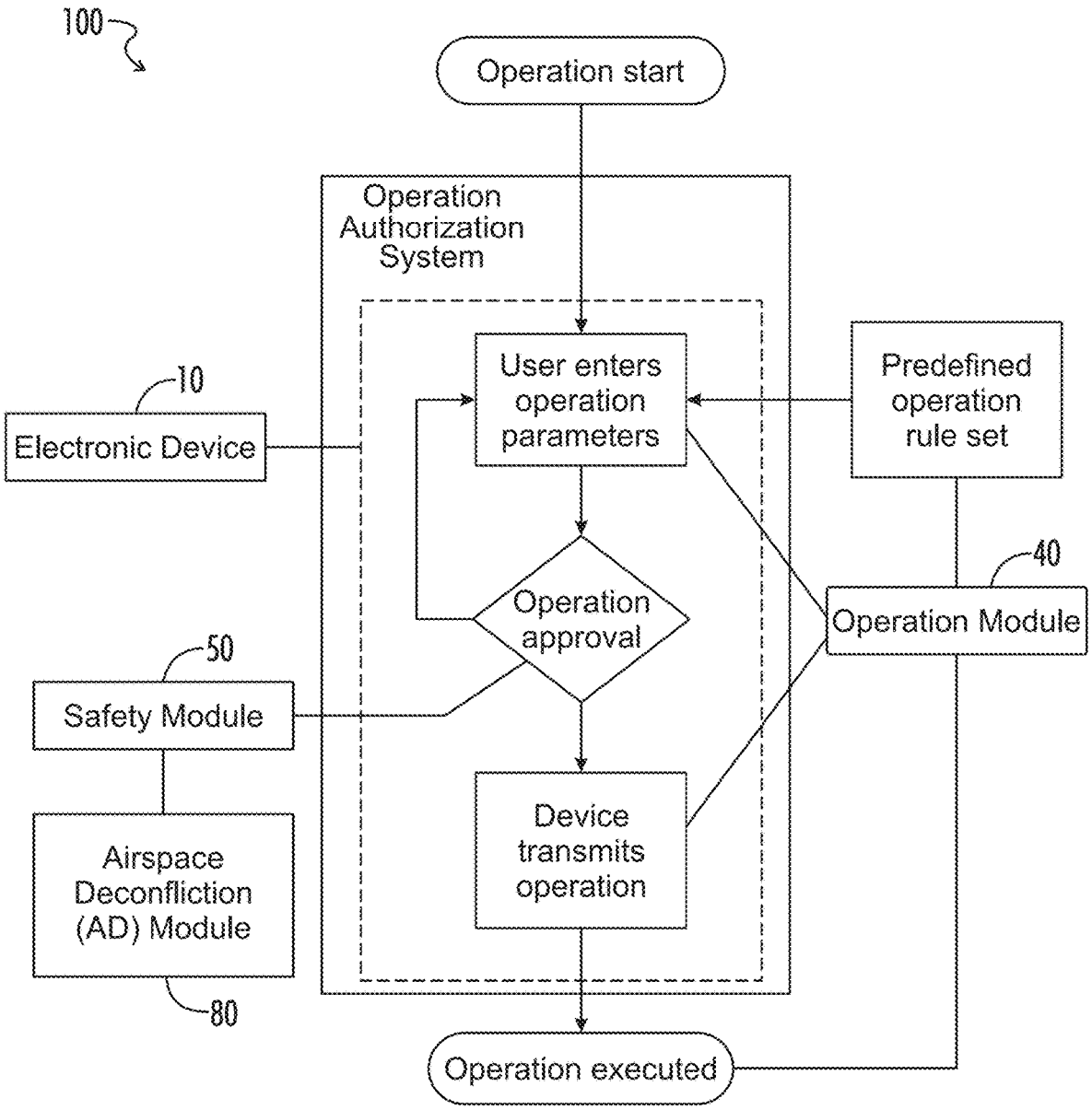
FIG. 8 illustrates an exemplary embodiment of a partial block diagram of a system for authorizing an operation for at least one portable launch assembly, the system comprising one or more electronic devices having a safety module and an operation module, in accordance with aspects of the present disclosure.

The method 200 may continue with an operation 206 of receiving parameters of the operation for the at least one portable launch assembly 60. The parameters of the operation for the at least one portable launch assembly 60 may be inputted, manually or otherwise, on the display unit 17 on at least one of the one or more electronic devices 10 vis-à-vis a user interface on the display unit 17. Authorization of the operation may initiate with the entry (and receipt) of the parameters of the operation by and through the operation module 40 of the operation approval unit 30, as depicted in FIGS. 8 and 9. The operation module 40 of the operation approval unit 30 may be executable by the controller 20 of any one of the one or more electronic devices 10. The plug-in 44, or the other software application 44, may be configured to receive the parameters of the operation for the at least one portable launch assembly 60, whether provided by a user of the one or more electronic devices 10, or provided by a centralized entity, such as the administrator 110. In optional embodiments, the plug-in 44 may further include a content provider 48, the content provider 48 of which may comprise a structured query language (SQL) database instantiated by the plug-in 44. The plug-in 44 may receive the parameters of the operation, as illustratively conveyed in FIG. 9, by and through the display unit 17 having the user interface (UI) associated therewith, and the content 48 may receive, from the CoT Listener 46, filtered information corresponding to the situational awareness (SA) of the one or more electronic devices 10. Parameters of the operation may comprise any instructions, directions, or other guidance for the at least one portable launch assembly 60, including an instruction to deliver, send, or project the launch unit 70 to, on, or against the intended area 134 in the potential area 120, as illustratively conveyed in FIG. 10. Other parameters of the operation may include an instruction to select more than one of the at least one portable launch assembly 60, the function of which is to deliver, send, or project a plurality of launch units 70 to, on, or against the intended area 134 (or more multiple landing sites 140) from a plurality of the at least one portable launch assembly 60 in the potential area 120. Other parameters of the operation may include an instruction to launch the launch unit 70 from the at least one portable launch assembly 60 based at least upon an airspace collision avoidance status.

Returning to the discussion of the method 200, the method 200 may continue with an operation 208 of selectively retrieving one or more predefined rules 210 related to at least the parameters of the operation for the at least one portable launch assembly 60. The content provider 48 of the plug-in 44 may have stored thereon one or more predefined rules 210 related to at least the parameters of the operation. The one or more predefined rules 210 may comprise a rule set that is deterministic, presented in human-readable syntax, and/or may include static or dynamic elements pertaining to the operation. In optional embodiments, the one or more predefined rules 210 may include information corresponding to at least one of a location of the one more electronic devices 10 and/or the at least one portable launch assembly 60 in the potential area 120, a location of the at least one portable launch assembly 60 in the potential area 120, a location of one or more landing sites 140 in the potential area 120, a location of one or more non-landing sites 142 in the potential area 120, a height of the launch unit 70 launched into the airspace over the potential area 120, a flight path of the launch unit 70 launched into the airspace over the potential area 120, or a time constraint on a duration of the operation, including a maximum future time for consideration ($t_{max}$). In other embodiments, the one or more predefined rules 210 may also include at least one of a height, roughness, or other characteristic of a surface of a terrain provided in the potential area 120, nominal flight-path data associated with the launch unit 70 launched into the airspace, or flight-path dispersions associated with the launch unit 70 launched into the airspace, and combinations thereof. In other optional embodiments, the one or more predefined rules 210 may comprise a rule set presenting criteria for which the operation for the at least one portable launch assembly 60 is at least one of the following: safe or unsafe conditions in the operation (e.g., presence of one or more non-landing sites 142), too soon or too late for a duration of the operation, or too close or too far within the potential area 120. And, in yet further optional embodiments, the one or more predefined rules 210 may include proximity to third-party entities or assets, including individuals, structures, or vehicles, all of which may be classified as the non-landing site 142 (or non-landing asset 142), or areas otherwise geofenced or kept out within the potential area 120.

The method may continue with an operation 212 of applying the one or more predefined rules 210 to the parameters of the operation based on at least the signals representative of a situational awareness (SA) and/or class information corresponding to each of the one or more electronic devices 10, a number of which may be associated with one or more of the at least one portable launch assembly 60, the launch unit 70, and/or the at least one air vehicle 150. Application of the one or more predefined rules 210 to the parameters of the operation based at least the signals representative of the situational awareness (SA) and/or class information corresponding to each of the one or more electronic devices 10 may be carried out by the safety module 50 in coordination with the airspace deconfliction (AD) module 80, both of which are executable by the operation approval unit 30 of the controller 20. The safety module 50 may receive, from the content provider 48 of the plug-in 44, information corresponding to the situational awareness (SA) and the parameters of the operation, as well as the one or more predefined rules 210 related to at least the parameters of the operation. In optional embodiments, the airspace deconfliction module 80 may receive, from the plug-in 44, information corresponding to the situational awareness (SA) and/or class information corresponding to each of the one or more electronic devices 10, a number of which may be associated with one or more of the at least one portable launch assembly 60, the launch unit 70, and/or the at least one air vehicle 150. In particular, the airspace deconfliction module 80 may receive information corresponding to the situational awareness (SA) and/or class information corresponding to the air vehicle 150 from the CoT Listener 46 and may receive information corresponding to the situational awareness (SA) and/or class information corresponding to the at least one portable launch assembly 60 from the plug-in 44. The application of the one or more predefined rules 210 by the safety module 50 may ascertain or determine whether the parameters of the operation comport with limitations or instructions provided by criteria of the one or more predefined rules 210.

With the application of the one or more predefined rules 210 by the safety module 50, the safety module 50 may receive, through the airspace deconfliction (AD) module, a request for an approval of the operation from the operation module 40, as exemplarily depicted by an operation 218 of the method 200 and illustratively conveyed in FIGS. 8-9. The method 200 may continue with an operation 220 of determining whether to accept or to reject the request for the approval of the operation for the at least one portable launch assembly 60. Evaluation of whether to accept or to reject the request for the approval of the operation for the at least one portable launch assembly 60 may be implemented based on the application of the one or more predefined rules 210 to the parameters of the operation, the application of which may include two-dimensional or three-dimensional assessments of the landing sites 140, the non-landing sites 142, locations of the one or more electronic devices 10 and the at least portable launch assembly 60, or the potential area 120, as well as characteristics pertaining to the terrain (and surfaces thereon) in the potential area 120.

Evaluation of whether to accept or to reject the request for the approval of the operation for the at least one portable launch assembly 60 may be further implemented based on an available launcher status provided from the airspace deconfliction (AD) module to the safety module 50. The airspace deconfliction (AD) module 80 may be executable by the operation approval unit 30 of the controller 20. The airspace deconfliction (AD) module 60 may run simultaneously in the plug-in 44 and the safety module 50. In optional embodiments, the airspace deconfliction (AD) module 60 may be a standalone module that receives information from and transmits information to both the plug-in 44 and the safety module 50. In other embodiments, the airspace deconfliction (AD) module 60 may be integrated with the safety module 50 or the plug-in 44. The airspace deconfliction (AD) module 60 may be configured to provide, to the safety module 50, one or more of the at least one portable launch assembly 60 available for launch based at least upon an airspace collision avoidance status. In optional embodiments, the airspace deconfliction (AD) module 60 may operate according to the data flow operation 300 to create launcher object, air vehicle objects, and detect interactions between the future position areas of the air vehicle and launcher objects ($FPA_A$) and ($FPA_L$), respectively.

The operation 212 may additionally include a determination of an airspace deconfliction status as described herein. The airspace collision avoidance status may be dynamically determinable by the airspace deconfliction (AD) module 80 over a maximum future time of consideration of launch of the launch unit 70. The determination of the airspace collision avoidance status may include consideration of a number of signals associated with a number of objects, including the one or more electronic devices 10, the at least one portable launch assembly 60, the at least one launch unit 70, and/or the at least one air vehicle 150. The consideration of a number of signals may include consideration of signals representative of the situation awareness (SA) of each or more the above mentioned objects, signals representative of a class of each of the above mentioned objects, and/or a time window representing the maximum time available to launch the launch unit 70.

Figure 5:
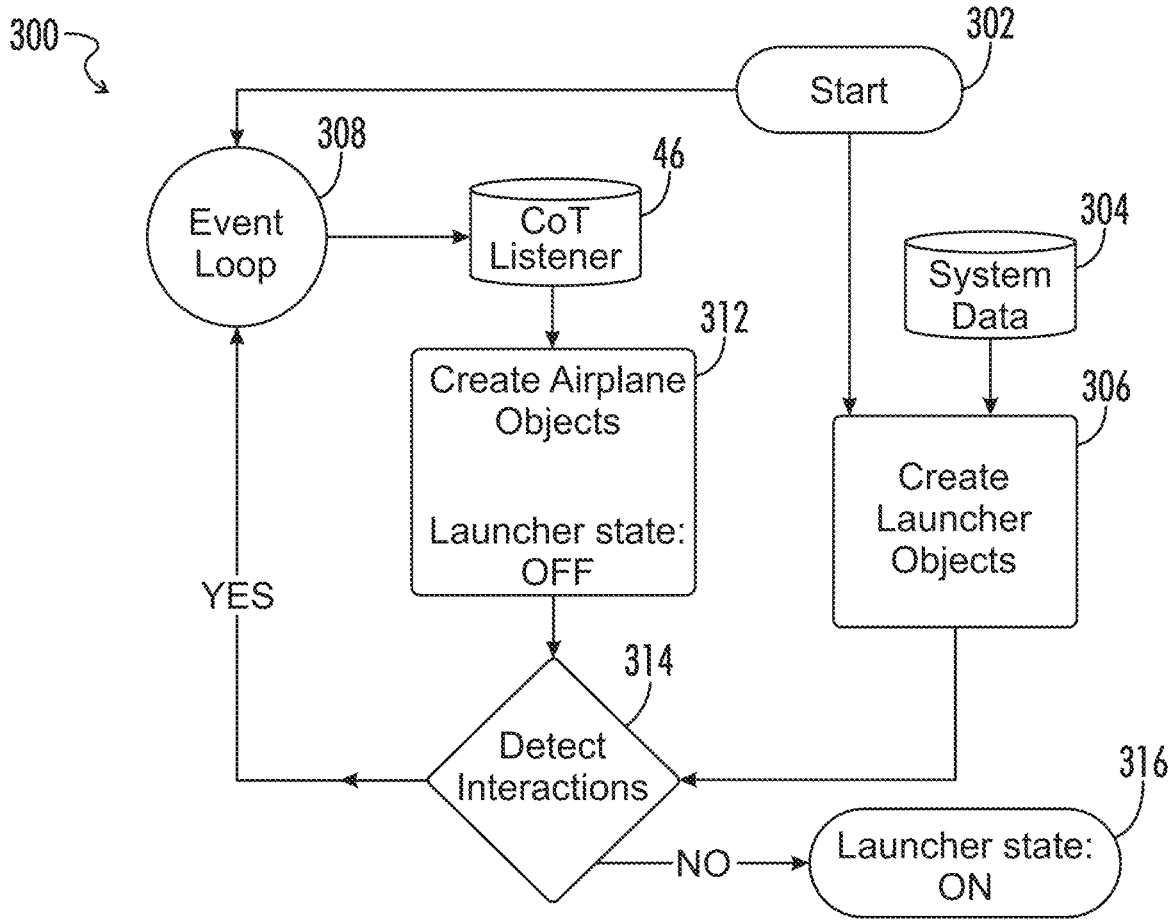
FIG. 5 illustrates a flowchart providing an exemplary embodiment of a method for determining an airspace collision avoidance status, in accordance with aspects of the present disclosure.

In optional embodiments, the determination of the airspace collision avoidance status may incorporate an exemplary data flow operation 300 as illustrated in FIG. 5. The data flow operation 300 may operate in an on/off result configuration, designating the launch of a launch unit 70 only when the launch state toggles to ON 316. Otherwise, if the data flow operation 300 cannot determine a valid airspace collision avoidance status, the data flow operation 300 remains in an OFF state and does not provide authorization to launch the launch unit 70. In an exemplary embodiment of the data flow operation 300, upon initiation of the data flow operation, the airspace deconfliction (AD) module 80 provides for the creation of launcher objects 306 via system data 304 This system data may include signals representative of the situational awareness (SA) and/or class information of the at least one portable launchers 60, including position location information (PLI), namely geocoordinate latitude, longitude, and altitude.

The data flow operation 300 may further operate to initiate an event loop 308. The event loop 308 may further operate to accept information associated with all of the at least one air vehicles 150 within 1° of the one or more electronic devices 10, including the CoT Listener device 46 that is included within the one or more electronic devices 10 of one or more of the at least one portable launch assembly 60, the launch unit 70, the user 132, and/or the observer 130.

The data flow operation 300 may continue to create air vehicle objects 312, with each air vehicle object associated with signals representative of situational awareness (SA) of each air vehicle 150, including position location information (PLI), position vector information (PVI), and/or air vehicle class information. In exemplary embodiments, the CoT Listener device 46 will create an air vehicle object 312 with position information, including geocoordinate latitude, longitude, altitude, and speed.

The data flow operation 300 may continue with a process of detecting possible interactions 314 between the air vehicle objects and the launcher objects. The process of detecting interactions 314 operates to detect possible points of intersection between an air vehicle future position area ($FPA_A$) 410 and a launcher object future position area ($FPA_L$) 402. For purposes of the present disclosure, reference to the launcher object future position area refers to a future position area determinable for any number of the at least one portable launch assembly 60 and/or the launch unit 70. The process of determining future position areas (FPAs) of both the air vehicle and the launch object will be described in greater detail herein.

The data flow operation 300 may continue with repeating the event loop 308 in the event that any potential interactions are detected between the air vehicle future position area ($FPA_A$) 410 and the launcher object future position area ($FPA_L$) 402, in which case, the launcher state will remain in an OFF position. The event loop for detecting interactions between the air vehicle future position area ($FPA_A$) 410 and the launcher object future position area ($FPA_L$) may repeat once every second or may be manually configured to repeat at any desired time interval. Alternatively, the data flow operation 300 may continue with authorizing the at least one portable launch assembly 60 for launch based on at least the lack of any interaction between the air vehicle future position area ($FPA_A$) 410 and the launcher object future position area ($FPA_L$), in which case, the launcher state will toggle to an ON position 316.

For purposes of the present disclosure, reference to any air vehicle or launcher object future position area refers to a volume of space that may be presently or in the future physically occupied by the at least one portable launch assembly 60, the launch unit 70, and/or the air vehicle 150, and is further used to detect whether an intersection may occur among any two or more of the determinable future position areas (FPAs). In optional embodiments, the future time used for determination of a future position area (FPA) may be established as a maximum future time for consideration ($t_{max}$) of the launch of the launch unit 70. As illustratively conveyed in FIG. 6, future position areas (FPAs) 400 may represent time-dependent hazard areas, representing the physical limits of where the launch unit 70 and/or the air vehicle 150 may be physically located for a given maximum future time for consideration ($t_{max}$). The future position areas (FPAs) are determinable to account for all potential positions of the launch unit 70 and/or the air vehicle 150 according to the physical limitations attributable to each of the launch unit and/or air vehicle. Accordingly, future position areas (FPAs) include determination of position uncertainties and latencies associated with the launch unit 70 and/or the air vehicle 150 such that the size of the future position areas (FPAs) are expanded to account for possible errors in a reported position and time since the position was last updated. Further, the future position areas (FPAs) 400 may be approximated as cylindrical volumes defined generally by a radius, a floor, and a ceiling—respectively, the distance from a surface of the earth ellipsoid 408 to the bottom or the top of the future position area (FPA) cylinder.

Figure 7:
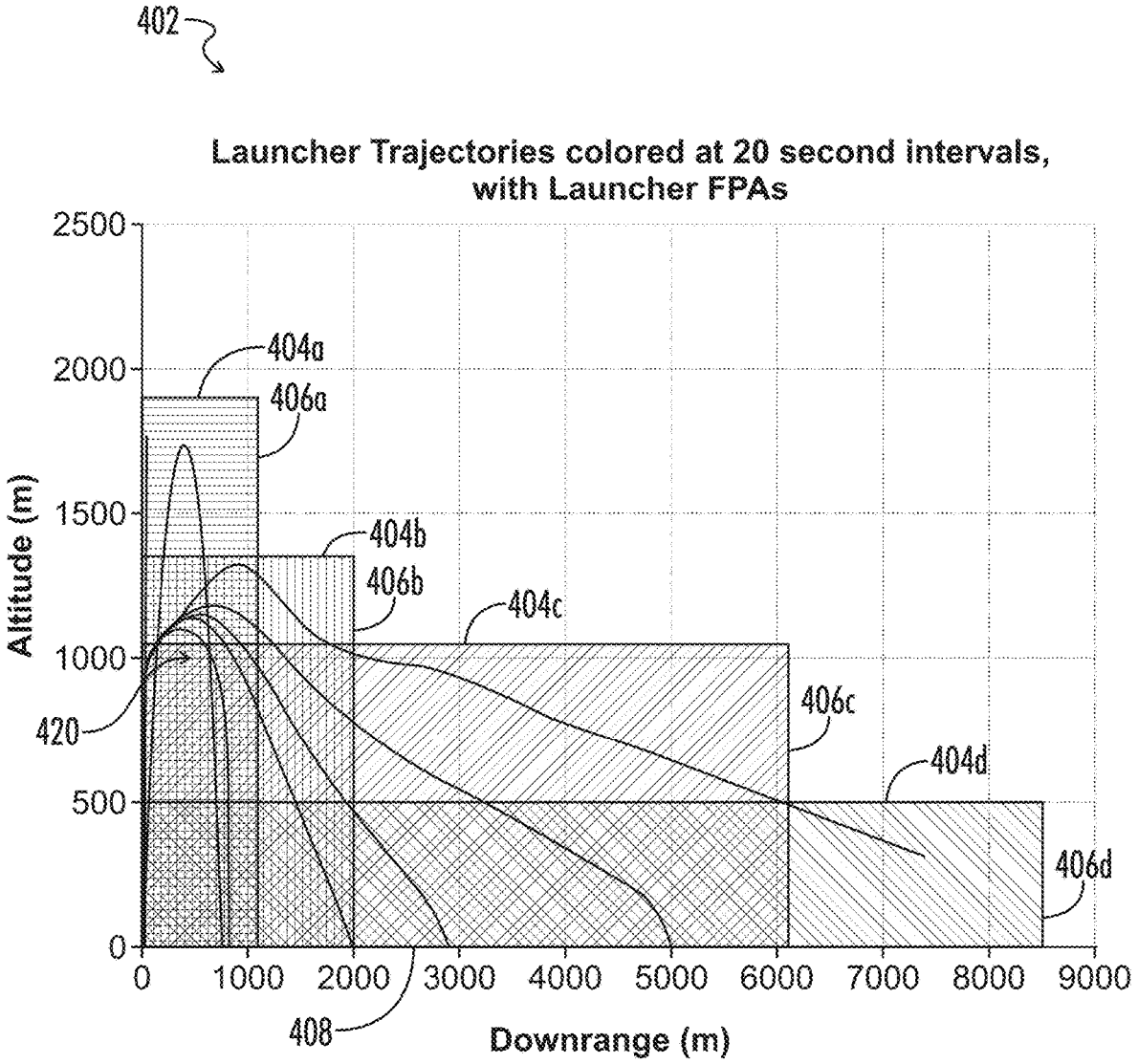
FIG. 7 illustrates an exemplary embodiment of a determination of a future position area of a portable launch assembly, in accordance with aspects of the present disclosure.

The future position area of the launch unit ($FPA_L$) 402 may be determinable according to all plurality of potential launch unit flight paths 420 of the launch unit 70, as illustratively conveyed in FIG. 7. In an illustrative embodiment with specific reference to FIG. 7, the launch unit (not shown) may be disposed at an origin of a cartesian coordinate system, with the X-axis of the coordinate system corresponding to a horizontal distance capable of being traveled by the launch unit 70 and the Y-axis of the coordinate system corresponding to a vertical distance capable of being traveled by the launch unit 70. In the illustrative embodiment of the future position area of the launch unit ($FPA_L$) 402 in FIG. 7, the maximum future time for consideration ($t_{max}$) may be a future time of consideration in which a future position area (FPA) may be occupied by the launch unit 70—$t_{max}$ being 20 seconds in one example. The future position area of the launch unit ($FPA_L$) 402 may be further determinable according to class information of the at least one portable launch assembly 60 and/or launch unit 70. In an exemplary embodiment, the class information of the at least one portable launch assembly 60 and/or launch unit 70 may include a maximum delta-v ($\Delta V$) and a maximum flight path. A maximum delta-v ($\Delta V$) may be a measure of the impulse per unit of launch unit 70 mass that is needed to perform a maneuver such as launching from a ground surface at a known geocoordinate position. A maximum flight path may be associated with an optimal glide ratio of a given launch unit 70.

The future position area of the launch unit ($FPA_L$) 402 may be further determinable by superimposing a plurality of potential launch unit flight paths 420. The plurality of potential launch unit flight paths 420 may be determinable based on consideration of at least one potential malfunction status associated with the launch of the launch unit 70. In an exemplary embodiment, the malfunction status associated with the launch of the launch unit 70 may include a failure of the guidance system, a failure of a wind or fin deployment, a failure of a launch, or any condition which may prevent the launch unit 70 from attaining a maximum flight path or an optimal glide ratio. Consideration of at least one potential malfunction status associated with the launch of the launch unit 70 may be represented by one or more of the plurality of potential launch unit flight paths 420 which either do not reach a maximum altitude or a maximum downrange distance. The plurality of potential launch unit flight paths 420 may have a number of different maximum launch altitudes (or ceilings) (404*a-d*) and a number of different downrange distances (or radii) (406*a-d*) representing the plurality of possible flight paths based upon consideration of the at least one potential malfunction status associated with the launch of the launch unit 70. Where the at least one portable launch assembly 60 is located on a ground surface 408, the floor of the future position area of the launch unit ($FPA_L$) 402 may be the ground surface. Accordingly, the plurality of potential launch unit flight paths 420 may be superimposed to determine the future position area of the launch unit ($FPA_L$) 402.

The future position area of the air vehicle ($FPA_A$) 410 may be determinable according to all potential aerospace maneuvers a given air vehicle 150 may perform. The future position area of the air vehicle ($FPA_A$) 410 as represented by a cylindrical volume as illustratively conveyed in FIG. 6 may be defined by a $FPA_A$ ceiling 412, a $FPA_A$ floor 414, and a $FPA_A$ radius 416. The future position area of the air vehicle ($FPA_A$) 410 may therefore be evaluated for two-dimensional maneuvers of the air vehicle 150 in addition to altitude changes. For any particular maximum future time for consideration ($t_{max}$), it may be possible for the air vehicle 150 to occupy any two-dimensional location with a radius of the current position of the air vehicle 150 as defined by the potential speed of the air vehicle. The future position area of the air vehicle ($FPA_A$) 410 may be further determinable according to class information of the air vehicle 150. Class information of the air vehicle 150 may include a maximum velocity ($V_{max}$) of the air vehicle 150 and/or a thrust/weight ratio of the air vehicle.

The maximum velocity ($V_{max}$) attainable by the air vehicle 150 may be determinable based upon a zoom dive maneuver of the air vehicle. In an exemplary embodiment, the maximum velocity ($V_{max}$) attainable by the air vehicle 150, neglecting drag, may be determinable according to the air vehicle's potential and kinetic energy according to the following specific energy equation:

$$\varepsilon^1 = h + \frac{V^2}{2g} \qquad \text{Equation 1.1}$$

The determination of the air vehicle's 150 maximum velocity ($V_{max}$) via a zoom dive maneuver assumes a dragless zoom dive (a perfect transfer from potential to kinetic energy). Some air vehicles may have sufficient thrust/weight ratios to also accelerate significantly at constant altitude. The specific energy equation provided may be solved for the final velocity of the zoom dive as a function of last reported velocity, the future time for consideration ($t_{max}$), and sink rate for a constant descent velocity. This equation is as follows:

$$V_{max}=\sqrt{V_{last}^2-2ght_{max}+h^2} \qquad \text{Equation 1.2}$$

The average velocity of the aircraft over the time $t_{max}$ can be calculated as well in the following equation:

$$V_{mean} = \frac{1}{t_{max}}\left[\frac{V_{last^2}t_{max} - \frac{3}{2}ght_{max}^2}{\sqrt{V_{last^2} - 2ght_{max}}}\right] \qquad \text{Equation 1.3}$$

Figure 6:
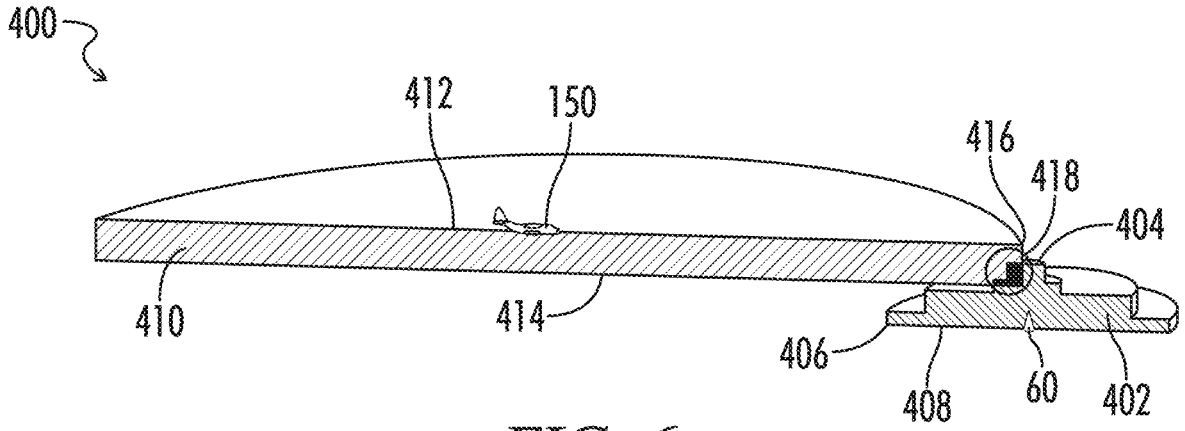
FIG. 6 illustrates an exemplary embodiment of a process for detecting interactions between an air vehicle and a portable launch assembly, in accordance with aspects of the present disclosure.

In an illustrative example of the determination of the future position area of the air vehicle ($FPA_A$) 410, as shown in FIG. 6, the air vehicle 150 may be located at a coordinate position (X, Y, Z) (0, 0, 0) at time t=0. Where the maximum future time for consideration ($t_{max}$) is greater than 30 seconds, then the air vehicle 150 will be capable of traveling for the maximum future time for consideration ($t_{max}$) at the maximum velocity attainable ($V_{max}$), in a straight line without altitude change to ($X+V_{max}*t_{max}$, Y), a straight zoom dive or zoom climb maneuver, or any combination thereof or variation therebetween.

The future position area of the air vehicle ($FPA_A$) 410 may also be based on a temporal uncertainty of the air vehicle 150. For instance, an air vehicle 150 may include a transponder (not shown) configured to report the position and speed of the air vehicle once every 1 to 10 seconds. Thus, a determination of the future position area of the air vehicle ($FPA_A$) 410 at time (t) may account for the passage of time (t+s) since the position and speed of an air vehicle 150 was last reported in determining the future position area of the air vehicle ($FPA_A$). Accordingly, a determination of the air vehicle future position area ($FPA_A$) radius 416 may include the sum of the following: (1) $V_{mean}*t_{max}$; (2) $V_{last}*$(device time—time of last reported position); and (3) air vehicle positional uncertainty or expected error, which includes temporal uncertainty in the launch time.

In other embodiments, the method 200 may also continue with an operation 214 of sending a plurality of test messages 216, at periodic intervals, to detect whether there is an error (or a fault) with the one or more electronic devices 10 in association with, and in communicative coupling to, one another, or whether there is an error with the secure network 102. The safety module 50 of the operation approval unit 30, executing independently of the operation module 40 of the operation approval unit 30, allows for a detection of errors or faults with the one or more electronic devices 10 or the secure network 102, as conveyed in FIG. 9. By sending, or injecting, the plurality test messages 216, at periodic intervals, the safety module 50 may determine errors or faults in any component of the operation module 40, including the communications and/or data exchanges among COMMO object 42, the plug-in 44, the CoT Listener 46, or the content provider 48. The safety module 50 may generate the plurality of test messages 216, otherwise referred to as a cursor-on-target (CoT) schema, transmitting the plurality of test messages 216 to the CoT Listener 46 of the plug-in 44. The plug-in 44 may record the plurality of the test messages 216 in the content provider 48, which is thereby read by the safety module 50. To the extent the error or the fault is detected, such data is validated or ignored, for the purpose of otherwise reliably executing the operation for the at least one portable launch assembly 60. In optional embodiments, the error may include at least one of a loss of communicative coupling of the one or more electronic devices 10, a latency in the communicative coupling of the one or more electronic devices 10, an uncertainty of a location of the one or more electronic devices 10 in the potential area 120, an uncertainty of a location of the at least one portable launch assembly 60 in the potential area 120, or an identification of at least one unknown device that is not associated with the one or more electronic devices 10. In other optional embodiments, the error (or the fault) may include at least one of invalid or incorrectly formatting data in at least one of the one or more electronic devices 10, a loss of data, such as data on the content provider 48 of at least one of the one or more electronic devices 10, missing (or absent) entries of parameters or the one or more predefined rules 210 in the content provider 48 indicating a loss of signal among the one or more electronic devices 10 or the network 102, out-of-sequence entries of parameters in the content provider 48 indicating clock- or time-related errors, missing (or absent) or misconfigured test messages 216 injected into the operation module 40, or an overflow of at least one or more electronic devices 10 or the network 102 caused by, for example, a denial-of-service or distributed denial-of-service, out-of-sequence entries, or simultaneous updating of more than one of the one or more electronic devices 10, such as updating the operation module 40 or another routine software component residing on the one or more electronic devices 10. To execute the operation for the at least one portable launch assembly 60, a detection of the error or the fault may require a consensus among the safety module 50 of each of the one or more electronic devices in the secure network 102, wherein a consensus mechanism may be employed to evaluate each safety module 50 against other of the safety module 50, for the purpose of shifting decision-making to the most reliable safety module 50 among the one or more electronic devices 10. Where the plurality of test messages 216 have been sent (or injected), at periodic intervals, into the operation module 40 of the operation approval unit 30, the operation 218 may further comprise obtaining the request for the approval of the operation for the at least one portable launch assembly 60 based on at least the one or more predefined rules 210 related to the parameters of the operation and whether the error is detected by the transmission (or injection) of the plurality of test messages 216 in accordance with the operation 214. The method 200 may then continue with the operation 220 of determining whether to accept or to reject the request for the approval of the operation for the at least one portable launch assembly 60.

Referring to FIG. 4, the method 200 may continue with an operation 222 or an operation 224. The operation 224 may include accepting the approval of the operation for the at least one portable launch assembly 60, such that the operation for the at least one portable launch assembly 60 may be executed; the operation 222, on the other hand, may include rejecting the approval of the operation for the at least one portable launch assembly 60, such that the operation for the at least one portable launch assembly 60 may not be executed. To the extent the approval of the operation for the at least one portable launch assembly 60 is rejected, the method 200 may re-continue with the operation 212 of applying the one or more predefined rules 210 to the at least signals representative of a situational awareness (SA) of the one or more electronic devices 10 (and any of the at least one portable launch assembly 60 associated therewith). This process may continue until the approval of the operation for the at least one portable launch assembly 60 is accepted in accordance with the remaining operations of the method 200. To the extent the approval of the operation for the at least one portable launch assembly 60 is accepted, the operation may be signed, or otherwise authenticated, such as through public/private two-path authentication exchanged among the one or more electronic devices 10. Each such signature or authentication of the operation for the at least one portable launch assembly 60 may be unique to each of the one or more electronic devices 10.

Referring to FIG. 10, an exemplary embodiment of the system 100 for authorizing the operation for the at least one portable launch assembly 60 is provided in the potential area 120, wherein the at least one portable launch assembly 60 comprises artillery equipment configured to mitigate avalanche activity in the potential area 120 by firing one or more launch units 70 from a surface into the airspace, and further onto or against the intended area 134 within the landing site 140. In the potential area 120, the one or more electronic devices 10 may be provided, wherein the at least one portable launch assembly 60 is associated therewith. The user 132, which may be operating at least one of the one or more electronic devices 10, may enter parameters of the operation for the at least one portable launch assembly 60, identifying a location of the landing sites 140 and the non-landing sites 142 within the potential area 120. Having inputted such parameters of the operation vis-à-vis the operation module 40, which are thereby received by the safety module 50, the one or more predefined rules 210 related at least to the parameters of the operation may be applied to the parameters of the operation. For example, the one or more predefined rules 210 could comprise geofencing within the potential area 120 or an identification of the non-landing sites 142 (or non-landing assets 142), such as the at least one portable launch assembly 60, the user 132, and the observer 130, coupled with an identification of landing sites 140, including the intended area 134 that is disposed on a terrain of the mountain, impact against which could mitigate avalanche activity. Using all directional and position-related information corresponding to at least the situational awareness (SA) and/or class information of the one or more electronic devices 10, coupled with a transmission of the plurality of test messages 216, at periodic intervals, across the one or more electronic devices 10, the safety module 50 may obtain the request for the approval of the operation, determining whether to accept or to reject the approval of the operation for the at least one portable launch assembly 60. To the extent, however, a fault or error is detected through the injection of the plurality of test messages 216 on the one or more electronic devices 10 or the network 102, the request for authorization of the operation for the at least one portable launch assembly 60 may be accepted or rejected. Assuming the approval of the operation is accepted, the operation for the at least one portable launch assembly 60 may be executed, such that the launch unit 70 may be launched in the direction of the intended area 134. Thereafter, a subsequent operation for the at least one portable launch assembly 60 may be authorized in accordance with the operations set forth in the method 200.

In other embodiments, the system 100 may be employed in connection with an operation for the at least one portable launch assembly 60, wherein the at least one portable launch assembly 60 (and the launch unit 70) comprises an unmanned aerial vehicles (UAV) system, such as (for example) a drone. The drone, which may include avionics hardware and software, may be launched into the airspace in the potential area 120. The user may enter parameters for the operation of the at least one portable launch assembly 60, including one or more intended areas 134 within landing sites 140. The parameters of the operation may have the one or more predefined rules 210 related thereto, the one or more predefined rules 210 of which may include those previously described above, as well as rules or criteria directed to governmental or regulatory-based limitations on the flight path of the launch unit 70, the height of the launch unit 70, or locations of the one or more landing sites 140 and the one or more non-landing sites 142 within the potential area 120. In optional embodiments, the potential area 120 may include a geographic territory having its own regulatory or ordinance-based criteria, including states, local districts, municipalities, cities, and other localities. The intended area 134 may be a household, a building, or other location that is the recipient of various articles carried by the UAV, such as goods, products, household items, or other articles deliverable vis-à-vis airborne delivery. Using directional and position-related information corresponding to at least the situational awareness (SA) and/or class information of the one or more electronic devices 10, coupled with a transmission of the plurality of test messages 216, at periodic intervals, across the one or more electronic devices 10, the safety module 50 may obtain the request for the approval of the operation for the UAV, determining whether to accept or to reject the approval of the operation to deliver articles at a location corresponding to the intended area 134 within the potential area 120.

Figure 11:
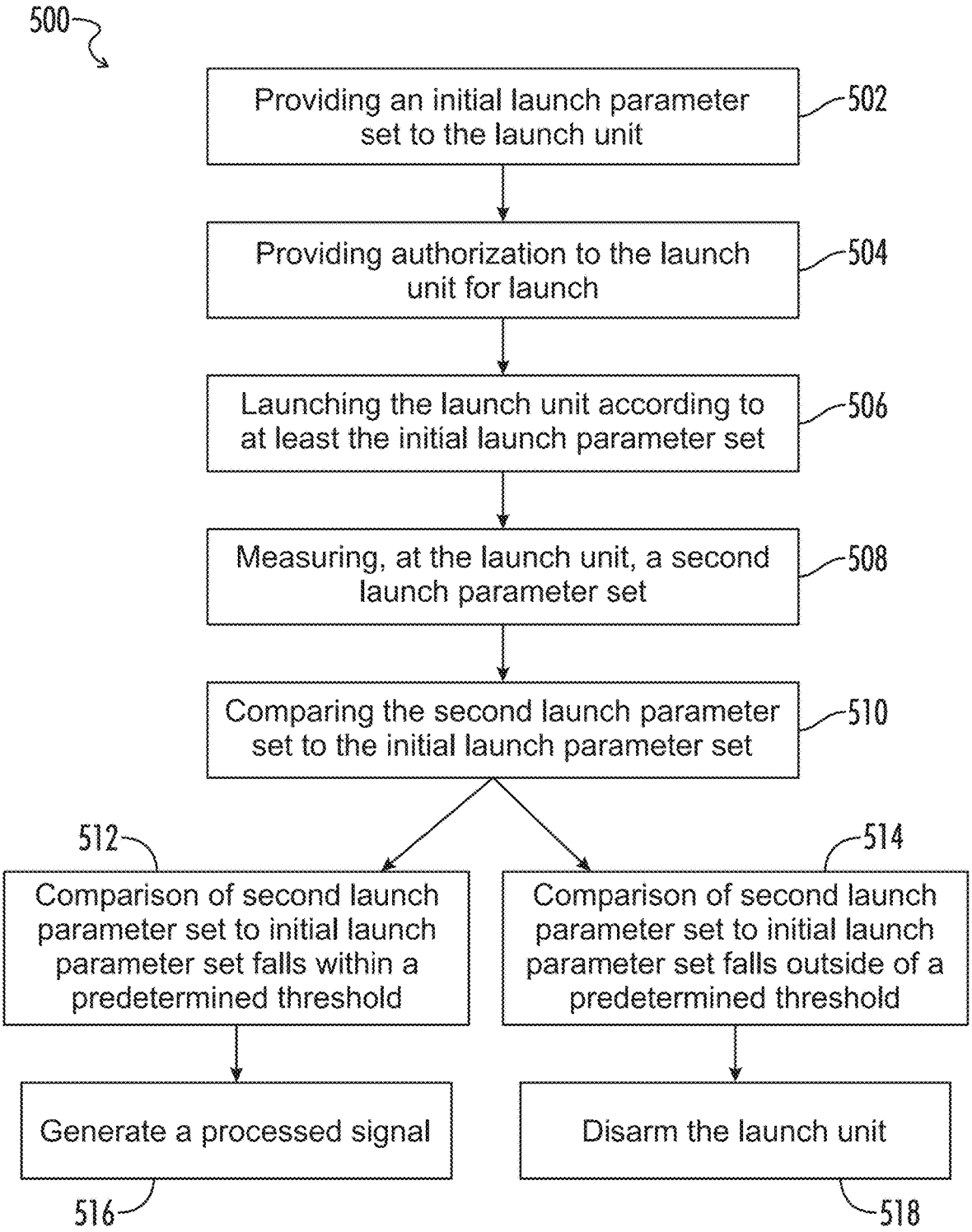
FIG. 11 illustrates a flowchart providing an exemplary embodiment of confirming an intended launch status of the launch unit, in accordance with aspects of the present disclosure.

In optional embodiments as illustratively conveyed in FIG. 11, the launch unit 70 and one or more electronic devices 10 associated with the launch unit 70 may perform a method 500 confirm an intended launch status of the launch unit 70. The term "intended launch status" as used herein provides for a confirmation that the launch unit 70 has launched according to an initial launch parameter set provided to the launch unit 70 before launch. The initial launch parameter set may include parameters of the operation for the at least one portable launch assembly as described herein, including information corresponding to the intended area for launch as located within the potential area. By way of example, the initial launch parameter set may include any instructions, directions, or other guidance for the at least one portable launch assembly 60, including an instruction to deliver, send, or project the launch unit 70 to, on, or against the intended area 134 in the potential area 120, as illustratively conveyed in FIG. 10. Other parameters of the operation may include an instruction to select more than one of the at least one portable launch assembly 60, the function of which is to deliver, send, or project a plurality of launch units 70 to, on, or against the intended area 134 (or more multiple landing sites 140) from a plurality of the at least one portable launch assembly 60 in the potential area 120. Other parameters of the operation may include an instruction to launch the launch unit 70 from the at least one portable launch assembly 60 based at least upon an airspace collision avoidance status. The initial launch parameter set may also include predefined threshold associated with a number of sensors, including, but not limited to, accelerometers, which measure (among other things) velocity and acceleration, gyroscopes, which measure (among other things) angular velocity and angular acceleration, magnetometers, which measure (among other things) strength and direction of a magnetic field, and any or more of a temperature sensor, a shock or impact sensor, a photodetector, an electrostatic sensor, an air pressure sensor, or a clock, timer, or sensor otherwise used to measure elapsed or absolute time.

The method of confirming the intended launch status of the launch unit 500 may include providing, in the launch unit 70, the initial launch parameter set before launch 502. Within the scope of the method 200, the step of providing the initial launch parameter set before launch 502 may be included within the operation of receiving parameters of the operation 206. Similarly, the operation of providing authorization to the launch unit for launch 504 may be included within the operation of accepting approval of the operation 222. The method of confirming the intended launch status of the launch unit 500 may continue with the operation of launching the launch unit according to at least the initial launch parameter set 506. The method of confirming the intended launch status of the launch unit 500 may continue with, at the launch unit 70, sensing and measuring a second launch parameter set 508. The second launch parameter set may be sensed and measured by an initiator (not shown) present in the launch unit 70. The second launch parameter set may correspond to information associated with the initial launch parameter set and may provide for a deviation from the initial launch parameter set by a predetermined threshold. The second launch parameter set may include information measured by the launch unit 70 after launch. In optional embodiments, the second launch parameter set may include a sequence of information measured by the launch unit 70 after launch. By way of example, the initial launch parameter set may include one or more of an acceleration, velocity, angular acceleration, angular velocity, shock or impact, air pressure, or time. The second launch parameter set may include information corresponding to one or more of an acceleration, velocity, angular acceleration, angular velocity, shock or impact, air pressure, or time as associated with the launch of the launch unit 70.

The method of confirming the intended launch status of the launch unit 500 may continue with, at the launch unit 70, comparing the second launch parameter set to the first launch parameter set 510. In optional embodiments, the step of confirming the intended launch status of the launch unit 70 may continue with generating a processed signal 516 via the controller 20 of the electronic device 10 associated with the launch unit 70. The processed signal may be associated with the comparison of the second launch parameter set to the initial launch parameter set such that the processed signal is generated only when the comparison of the second launch parameter set to the initial launch parameter set falls within the predetermined threshold 512. The predetermined threshold may represent an acceptable level of deviation between the second launch parameter set and the initial launch parameter set that allows for the launch unit 70 to reach the intended area. In the absence of the processed signal, the controller 20 of the electronic device 10 associated with the launch unit 70 may disarm the launch unit 518. The disarming of the launch unit 518 may be associated with an in-flight disarm feature. In the presence of the processed signal, the controller 20 of the electronic device 10 associated with the launch unit 70 may be configured to deploy at least one wing and/or at least one fin of the launch unit as further described herein. The method of confirming the intended launch status of the launch unit 500 may occur, from the launch of the launch unit to the generation of the processed signal, or alternatively the disarming of the launch unit, within two (2) seconds of launch. In optional embodiments, the time to confirm the intended launch status of the launch unit may be set by a user 132 or administrator 110.

Figure 12:
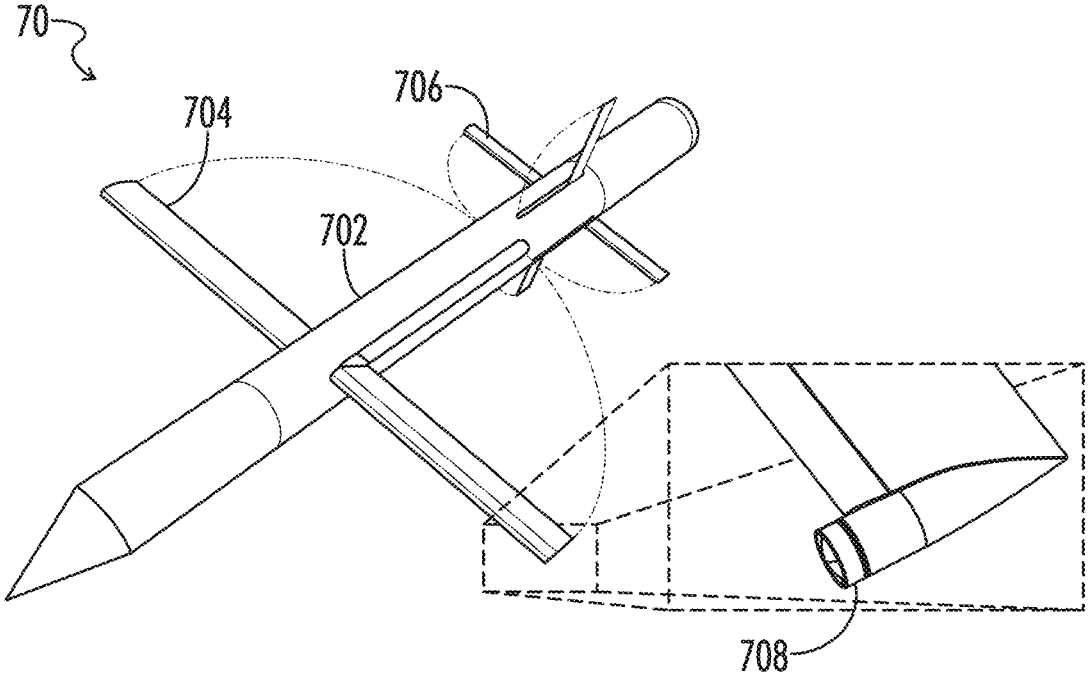
FIG. 12 illustrates an exemplary embodiment of a launch unit, in accordance with aspects of the present disclosure.

As shown in the exemplary embodiment depicted in FIG. 12, the launch unit 70 may include a launch unit frame 702, at least one deployable wing 704, and at least one deployable and maneuverable fin 706. In optional embodiments, the at least one deployable wing 704 may further include a camera 708. The camera 708 may be integrated with the wing 704 or may be mounted on the wing 704 on any location of the wing 704 that allows the camera's field of view to view in the traveling direction of the launch unit 70. The controller 20 of the electronic device 10 associated with the launch unit 70 may be further configured to move the at least one deployable and maneuverable fin 706 according to images received from the camera 708.

Figure 13:
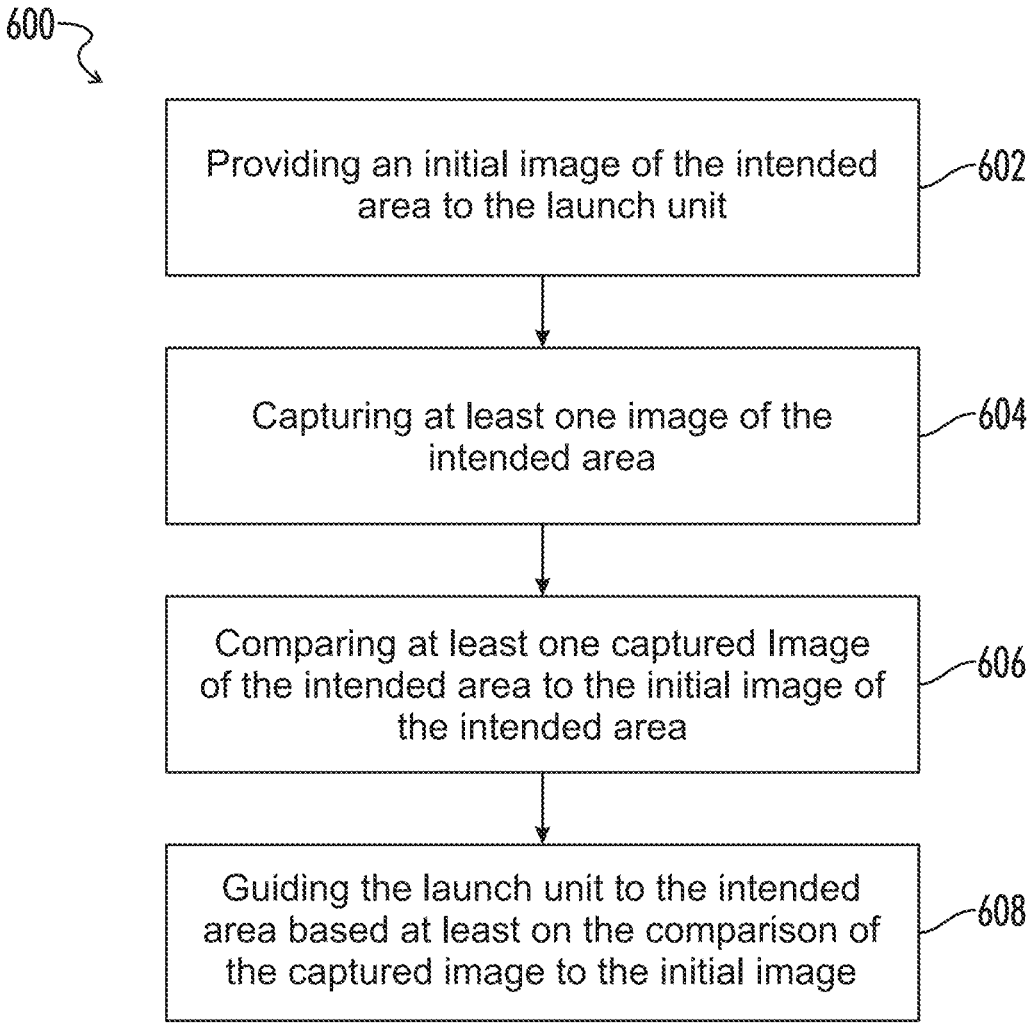
FIG. 13 illustrates a flowchart providing an exemplary embodiment of guiding a launch unit to an intended area, in accordance with aspects of the present disclosure.

In optional embodiments, the controller 20 of the electronic device 10 associated with the launch unit 70 may be further configured to perform an operation of guiding the launch to the intended area 600, as illustratively conveyed in FIG. 13. In the method of guiding the launch unit to the intended area 600, the launch unit may be provided with the initial launch parameter set 602. The initial launch parameter set may include one or more initial images of the intended area 134 within the potential area 120. The initial image of the intended area may be provided to the launch unit by one or more of the electronic devices 10 and may include geocoordinate location provided by GPS, satellite imagery, drone image feed, air vehicle image feed, or any other source capable of providing an image of the intended area 134. In optional embodiments, the initial image may correspond to the initial launch parameter set and may be included in the initial launch parameter set.

After launch of the launch unit 70, the method of guiding the launch unit to the intended area 600 may continue with capturing, at the launch unit 70, at least one image of the intended area to provide at least one captured image 604.

After capturing at least one image of the intended area, the method of guiding the launch unit to the intended area 600 may continue with comparing the at least one captured image of the intended area to the initial image of the intended area 606. Based on the comparison of the at least one captured image of the intended area to the initial image of the intended area, the controller 20 of the electronic device 10 associated with the launch unit 70 may be further configured to establish a trajectory of the launch unit 70 from the current position of the launch unit to the intended area. Based on the comparison of the at least one captured image of the intended area to the initial image of the intended area, the controller 20 of the electronic device 10 associated with the launch unit 70 may be further configured to move the at least one deployable and maneuverable fin 706 to perform the operation of guiding the launch unit to the intended area 608.

To facilitate the understanding of the embodiments described herein, a number of terms have been defined above. The terms defined herein have meanings as commonly understood by a person of ordinary skill in the areas relevant to the present invention. The terminology herein is used to describe specific embodiments of the invention, but their usage does not delimit the invention, except as set forth in the claims.

The term "user" as used herein unless otherwise stated may refer to an operator, an autonomous system, or any other person or entity as may be, e.g., associated with the electronic device 10, the at least one portable launch assembly 60, the system 100, the network 102, and/or the administrator 110.

The term "launch" or "launched," as used in connection with the launch unit 70, may refer to a launch of the launch unit 70 from the surface into the airspace over the potential area 120. The launch unit 70 of the at least one portable launch assembly 60 may be launched from the surface into the airspace by dispatch or vertical lift-off, including through rotor-based movement of propellers (e.g., drone), or by propulsion, ejection, or discharge, such as projectiles fired from a barrel or tube (e.g., artillery equipment configured to mitigate avalanche activity).

The term "processor" as used herein may refer to at least general-purpose or specific-purpose processing devices, such as a central processing unit, and/or logic as may be understood by one of skill in the art, including but not limited to a microprocessor, a microcontroller, a state machine, and the like. The processor can also be implemented as a combination of computing devices, e.g., a combination of a digital signal processor (DSP) and a microprocessor, a plurality of microprocessors, one or more microprocessors in conjunction with a DSP core, or any other such configuration.

It is understood that various operations, steps, or algorithms, including the method 200, as described in connection with the system 100, including (without limitation) the one or more electronic devices 10 (including those of the one or more electronic devices 10 associated with the at least one portable launch assembly 60), the administrator 110, or alternative devices or computer structures or hierarchies, can be embodied directly in hardware, in a computer program product such as a software module executed by the processor 13 or any process related to, or embodied by, the foregoing. The computer program product can reside in the storage 18, which may include RAM memory, flash memory, ROM memory, EPROM memory, EEPROM memory, registers, hard disk, a removable disk, or any other form of computer-readable medium known in the art.

Terms such as "a," "an," and "the" are not intended to refer to only a singular entity, but rather include the general class of which a specific example may be used for illustration.

The phrases "in one embodiment," "in optional embodiment(s)," and "in an exemplary embodiment," or variations thereof, as used herein does not necessarily refer to the same embodiment, although it may.

As used herein, the phrases "one or more," "at least one," "at least one of," and "one or more of," or variations thereof, when used with a list of items, means that different combinations of one or more of the items may be used and only one of each item in the list may be needed. For example, "one or more of" item A, item B, and item C may include, for example, without limitation, item A or item A and item B. This example also may include item A, item B, and item C, or item B and item C.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements, and/or states. The conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. Thus, such conditional language is not generally intended to imply that features, elements, and/or states are in any way required for one or more embodiments, whether these features, elements, and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this disclosure except as set forth in the following claims. Thus, it is seen that the apparatus of the present disclosure readily achieves the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims.

I claim:

1. A method of autonomously authorizing an operation for a portable launch assembly, the portable launch assembly configured to launch a launch unit into an airspace over a potential area, the method comprising:

providing an initial launch parameter set to the launch unit, the initial launch parameter set corresponding to an intended area located within the potential area;

forming a secure network comprising a plurality of electronic devices, wherein a first electronic device of the plurality of electronic devices is associated with the portable launch assembly positioned at a current location within the potential area;

receiving, at a second electronic device of the plurality of electronic devices and via the secure network, signals representative of a class of the launch unit and a class of the portable launch assembly, wherein the class of the launch unit and the class of the portable launch assembly indicate information characteristic of respective physical limitations on a possible launch associated with each of the launch unit and the portable launch assembly;

receiving, at the second electronic device and via the secure network, signals representative of a class of an air vehicle, wherein the class of the air vehicle indicates information characteristic of physical operating parameters thereof;

receiving, at the second electronic device and via the secure network, signals representative of a situational awareness (SA) of the launch unit and a situational awareness (SA) of the air vehicle, wherein each of the situational awareness (SA) of the launch unit and the situational awareness (SA) of the air vehicle includes respective position location information and/or position vector information;

receiving, at the second electronic device and via the secure network, a maximum future time of launch consideration ($t_{max}$);

dynamically determining, independently of the provided initial launch parameter set, future position areas of the launch unit and corresponding future position areas of the air vehicle based at least on the signals representative of the class of the launch unit, the signals representative of the class of the air vehicle, the signals representative of the situational awareness (SA) of the launch unit, the signals representative of the situational awareness (SA) of the air vehicle, and the maximum future time of launch consideration ($t_{max}$);

automatically determining an airspace collision avoidance status, over a time period corresponding to the maximum future time of launch consideration ($t_{max}$), based at least upon predicted interactions, or lack thereof, between the determined future position areas of the launch unit and the determined corresponding future position areas of the air vehicle;

selectively retrieving a deterministic rule set related to at least the initial launch parameter set;

independently of the determined airspace collision avoidance status, applying the rule set to the initial launch parameter set based on the signals representative of the class of the launch unit, the signals representative of the class of the air vehicle, the signals representative of the situational awareness (SA) of the launch unit, and the signals representative of the situational awareness (SA) of the air vehicle;

generating a request for authorization for launching the launch unit;

automatically providing authorization, to the first electronic device and via the secure network, for launching of the launch unit onto or against the intended area within the potential area, based at least upon the application of the rule set to the initial launch parameter set and the determined airspace collision avoidance status; and based on the provided authorization, launching the launch unit from the portable launch assembly according to the initial launch parameter set.

2. The method of claim 1, further comprising:

at the launch unit:

measuring a second launch parameter set;

confirming an intended launch status of the launch unit by comparing the second launch parameter set to the initial launch parameter set; and guiding the launch unit to the intended area.

3. The method of claim 2, wherein confirming the intended launch status occurs within 2 seconds of launching the launch unit.

4. The method of claim 2, wherein confirming the intended launch status of the launch unit further comprises:

generating a processed signal based at least on the compared launch parameter sets; and disarming the launch unit in the absence of the processed signal.

5. The method of claim 2, further comprising:

at the launch unit, deploying at least one wing and at least one fin based on the confirmed intended launch status.

6. The method of claim 2, wherein:

the second launch parameter set comprises at least one of heat, shock, light, static electricity, spin, acceleration, air pressure, or time elapsed since the launch.

7. The method of claim 2, wherein:

the second launch parameter set further comprises a sequence of second launch parameter sets.

8. The method of claim 2, further comprising:

capturing at least one image of the intended area at the launch unit;

wherein providing the initial launch parameter set to the launch unit further comprises providing an initial image of the intended area; and wherein guiding the launch unit to the intended area further comprises comparing the at least one captured image of the intended area to the initial image of the intended area.

9. The method of claim 1, wherein:

receiving the signals representative of the class of the launch unit further comprises receiving a maximum launch impulse per mass ($\Delta V$) and a maximum glide ratio of the launch unit; and determining the future position areas of the launch unit further comprises:

determining future position areas based on at least one potential malfunction status of the launch unit;

determining future position areas based on a maximum flight path of the launch unit; and superimposing the future position areas based on the at least one potential malfunction status and the future position areas based on the maximum flight path of the launch unit.

10. The method of claim 1, wherein:

receiving the signals representative of the class of the air vehicle further comprises receiving a maximum velocity of the air vehicle;

receiving the signals representative of the situational awareness (SA) of the air vehicle further comprises receiving signals representative of a time when the signals representative of the situational awareness (SA) of the air vehicle were reported and signals representative of a last reported velocity ($V_{last}$); and determining the future position areas of the air vehicle is based further on at least one of the maximum velocity of the air vehicle, the time when the signals representative of the situational awareness (SA) of the air vehicle were reported, and the last reported velocity ($V_{last}$).

11. The method of claim 1, wherein receiving the signals representative of the situational awareness (SA) of the air vehicle occurs once every 1 to 10 seconds.

* * * * *